US005147765A

United States Patent [19]

Goto et al.

[11] Patent Number: 5,147,765

[45] Date of Patent: Sep. 15, 1992

[54] PROCESS COMPRISING BLEACHING, BLEACH-FIX AND FIXING SILVER HALIDE COLOR PHOTOGRAPHIC MATERIAL

[75] Inventors: Masatoshi Goto; Yoshihiro Fujita; Shigeru Nakamura, all of Kanagawa, Japan

[73] Assignee: Fuji Photo Film Co., Ltd., Kanagawa, Japan

[21] Appl. No.: 607,325

[22] Filed: Oct. 31, 1990

[30] Foreign Application Priority Data

Nov. 7, 1989 [JP] Japan ..... 1-289332
Dec. 29, 1989 [JP] Japan ..... 1-342986
Aug. 16, 1990 [JP] Japan ..... 2-216389

[51] Int. Cl.[5] ..... G03C 7/40; G03C 7/42; G03C 5/38

[52] U.S. Cl. ..... 430/376; 430/393; 430/400; 430/418; 430/455; 430/460; 430/461; 430/963

[58] Field of Search ..... 430/393, 400, 418, 460, 430/455, 461, 963, 376

[56] References Cited

U.S. PATENT DOCUMENTS 4,717,647 1/1988 Abe et al. ..... 430/393
5,002,861 3/1991 Nakazyo et al. ..... 430/393
5,068,170 11/1991 Abe ..... 430/393

FOREIGN PATENT DOCUMENTS 0219113 4/1987 European Pat. Off. .
0329086 8/1989 European Pat. Off. .
0330043 8/1989 European Pat. Off. .
1399030 6/1975 United Kingdom .

OTHER PUBLICATIONS

Patent Abstracts of Japan, vol. 10, No. 341, (P-517) (2397), Nov. 18, 1986, & JP-A-61 143755, (Fuji Photo Film Co., Ltd.), Jul. 1986.

*Primary Examiner*—Richard L. Schilling
*Attorney, Agent, or Firm*—Sughrue, Mion, Zinn, Macpeak & Seas

[57] ABSTRACT

A method for processing silver halide color photographic materials is disclosed, comprising:

(1) color-developing an imagewise exposing silver halide color photographic material with a primary aromatic amine based color developing agent, and then (2) desilvering said photographic material by a process comprising the following steps conducted in sequence:

(a) treating in a bleaching bath, (b) treating in a bleach-fixing bath, and (c) treating in a fixing bath, wherein said bleaching bath is a bath of a bleaching solution having a pH of not more than 5.0 which contains an aminopolycarboxylic acid ferric complex salt having a redox potential of at least 150 mV, said fixing bath is a bath of a fixing solution having a pH of at least 6.5 which contains an aminopolycarboxylic acid whose corresponding ferric complex salt has a redox potential of less than 150 mV, or a salt of said acid, and said bleach-fixing bath comprises at least a bleaching solution which has been introduced from said bleaching bath and a fixing solution which has been introduced from said fixing bath.

21 Claims, No Drawings

PROCESS COMPRISING BLEACHING, BLEACH-FIX AND FIXING SILVER HALIDE COLOR PHOTOGRAPHIC MATERIAL

FIELD OF THE INVENTION

The present invention concerns a method for processing silver halide color photographic materials, and in particular, it concerns a method for processing the materials in which the desilvering process is definitely completed in a short period of time, which is improved in respect of color restoration failure and in that staining does not occur with the passage of time.

BACKGROUND OF THE INVENTION

The basic operation in the processing of silver halide color photographic materials (referred to hereinafter as color photosensitive materials), in general, consists of a color development process and a desilvering process. In the color development process, the exposed silver halide is reduced by a color developing agent to form silver and at the same time the oxidized color developing agent reacts with a color forming agent (a coupler) and provides a dye image. Then, in the subsequent desilvering process, the silver which has been produced in the color development process is oxidized by the action of an oxidizing agent which is commonly called a bleaching agent and then dissolved by means of a complex silver ion forming agent which is commonly called a fixing agent. Only the dye image is then left behind in the color photographic material as a result of passing through this desilvering process.

The desilvering process described above can consist of a procedure involving two baths, namely, a bleaching bath which contains a bleaching agent and a fixing bath which contains a fixing agent, a procedure involving a single bleach-fixing bath in which both bleaching agent and fixing agent are present, a procedure involving two baths consisting of a bleaching bath and a bleach-fixing bath, or a procedure involving three baths, namely, a bleaching bath, a bleach-fixing bath and a fixing bath, for example. Furthermore, each of these baths may in fact be comprised of a plurality of tanks.

Actual development processing includes various auxiliary operations as well as the basic operations indicated above for maintaining the photographic and physical quality of the image and for improving the storage properties of the image. For example, use is made of film hardening baths, stopping baths, image stabilizing baths and water washing baths.

Recent years have seen the widespread use of small in-store processing service systems known as mini-labs and there is a need for a shortening of the time required for processing as described above in order to meet the demand for rapid and reliable processing.

In particular, there has been a great demand for a shortening of the desilvering process which takes up the greater part of the processing time in conventional processing.

However, the ethylenediaminetetraacetic acid ferric complex salts which are used in the main as the bleaching agents which are used in bleaching baths and bleach-fixing baths have a fundamental weakness in that they have only a weak oxidizing power and, although improvements can be achieved with the conjoint use of various bleaching accelerators, they are unable to satisfy the aforementioned demands.

Furthermore, methods of processing in which the pH of the bleaching bath or bleach-fixing bath is reduced in order to increase the oxidizing power of the ethylenediaminetetraacetic acid ferric complex salts have been adopted, but in processing methods of this type color formation failure due to the formation of leuco cyan dyes, a phenomenon known as color restoration failure occurs.

On the other hand, ferricyanide, dichromates, ferric chloride, persulfate and bromates, for example, are all known as bleaching agents which have a strong oxidizing power, but these materials present many disadvantages from the viewpoints of environmental protection, safety in handling and metal corrosion, for example, and the situation is such that they cannot be widely used in in-store processing applications, for example.

Among these agents, bleaching baths having a pH of about 6 which contain 1,3-diaminopropanetetraacetic acid ferric complex salts which have a redox potential of at least 150 mV and a strong oxidizing power have been used, for example, in JP-A-62-222252 (the term "JP-A" as used herein refers to a "published unexamined Japanese patent application"), and it is possible to bleach silver more rapidly in this way than with bleaching baths which contain ethylenediaminetetraacetic acid ferric complex salts, but there is a disadvantage in that color fogging of a type known as bleaching fogs occurs if the bleaching process is carried out directly after color development without passing through an intermediate bath. Furthermore, bleaching baths containing 1,3-diaminopropanetetraacetic acid ferric complex salts (for example, at pH 5.0) have also been disclosed in JP-A-62-24253.

The above mentioned bleaching baths can be used in desilvering operations with two processing baths with a fixing bath or a processing bath which has a fixing ability, such as a bleach-fixing bath, following the bleaching bath.

Furthermore, methods of processing in bleaching baths having a low pH as disclosed in JP-A-1-206341 are known as a means of achieving rapid silver bleaching and overcoming the problem of bleach fogging, but color restoration failure inevitably occurs with this technique.

Processing with a color restoring bath having a high pH after the bleaching process as disclosed in JP-A-64-558 is known as a means of overcoming color restoration failure, but these methods are not compatible with rapid processing.

Furthermore, when processing is carried out in a bleaching bath which contains 1,3-propylenediaminetetraacetic acid ferric complex salt there is a definite problem with the considerable staining which occurs with the passage of time after processing as compared to the case of bleaching baths which contain ethylenediaminetetraacetic acid ferric complex salts.

SUMMARY OF THE INVENTION

Hence, an object of the present invention is to provide a method for processing the silver halide photographic material with which rapid processing with excellent desilvering properties and bleach fogging properties can be achieved and with which there is less color restoration failure or staining with the passage of time.

The present inventors have discovered that the aforementioned problems can be overcome by means of the method which is described below. That is, the object of the present invention has been realized by means of a method for processing silver halide color photographic materials comprising:

(1) color-developing an imagewise exposed silver halide color photographic material with a primary aromatic amine based color developing agent, and then (2) desilvering said photographic material by a process comprising the following steps conducted in sequence:

(a) treating in a bleaching bath, (b) treating in a bleach-fixing bath, and (c) treating in a fixing bath, wherein said bleaching bath is a bath of a bleaching solution having a pH of not more than 5.0 which contains an aminopolycarboxylic acid ferric complex salt having a redox potential of at least 150 mV, said fixing bath is a bath of a fixing solution having a pH of at least 6.5 which contains an aminopolycarboxylic acid whose corresponding ferric complex salt has a redox potential of less than 150 mV, or a salt of said acid, and said bleach-fixing bath comprises at least a bleaching solution which has been introduced from said bleaching bath and a fixing solution which has been introduced from said fixing bath.

DETAILED DESCRIPTION OF THE INVENTION

The present invention is described in detail below. In the method for processing silver halide color photographic materials (referred to hereinafter as photosensitive materials) of the present invention, the photosensitive material is color developed after imagewise exposure and then subjected to a desilvering process with a bleaching bath—bleach-fixing bath—fixing bath sequence.

Furthermore, the tank construction of each of the bleaching, bleach-fixing and fixing baths used in this process may involve a single tank or it may involve two or more tanks (for example, from 2 to 4 tanks).

A water washing bath may be established between the color development process and the desilvering process, but desilvering is preferably carried out immediately after color development in order to realize the effect of the present invention to the fullest.

In the present invention, the desilvering process is carried out in the order bleaching bath—bleach-fixing bath—fixing bath and the bleaching bath and the fixing bath are both replenished with a bleaching solution and a fixing solution, but the processing solution in the bleach-fixing bath (the bleach fixer) is formed with at least a bleaching solution which has been introduced from the bleaching bath and a fixing solution which has been introduced from the fixing bath.

The bleach-fixing solution is prepared and replenished principally using the method described above, but it can also be replenished with small amounts of a separate bleach-fixing replenisher.

When the bleach-fixing bath is comprised of a plurality of tanks, preparation of the bleach-fixing solution as described above in the last tank of the bleach-fixing bath with a countercurrent replenishment system to the preceding tank(s) is preferred.

This process and the method for preparing the bleach-fixing solution have been disclosed in JP-A-61-143755.

A distinguishing feature of the present invention is that in the preparation of the bleach-fixing solution in the system aforementioned, the bleaching solution is a solution having a pH of not more than 5.0 which contains an aminopolycarboxylic acid ferric complex salt of which the redox potential is at least 150 mV and the fixing solution is a solution having a pH of at least 6.5 which contains an aminopolycarboxylic acid or a salt thereof of which the redox potential of the corresponding ferric complex salt is less than 150 mV.

The mixing together of such a bleaching solution and a fixing solution results in a chelate exchange between the aminopolycarboxylic acid ferric complex salt of which the redox potential is at least 150 mV and the aminopolycarboxylic acid or salt thereof of which the redox potential of the ferric complex salt is less than 150 mV in the bleach-fixing bath with the formation of an aminopolycarboxylic acid ferric complex salt of which the redox potential is less than 150 mV, and this functions as the oxidizing agent in the bleach-fixing solution.

Each of the processing solutions is described in detail below.

The bleaching solution which is used in the present invention is described first of all, and the term "bleaching solution" as used herein signifies the bleaching solution in the bleaching bath and the bleaching bath replenisher.

The redox potential of the oxidizing agent (bleaching agent) of the bleaching solution described in the present invention is defined as the redox potential which can be measured using the method described on pages 1312 to 1313 of *Transactions of the Faraday Society,* Vol. 55 (1959). An aminopolycarboxylic acid ferric complex salt of which the redox potential obtained by the method mentioned above with reference to a standard hydrogen electrode potential (NHE) under conditions of pH 6.0 is at least 150 mV is used as the oxidizing agent in the bleaching solution of the present invention. Inorganic compound such as potassium ferricyanide, ferric chloride, dichromate, persulfate and bromate, for example, and some organic compounds such as some of the aminopolycarboxylic acid ferric complex salts behave as oxidizing agents which have a redox potential at pH 6.0 of at least 150 mV, but the aminopolycarboxylic acid ferric complex salts are used in the present invention from the view-points of environmental protection, safety in handling and metal corrosion, etc.

Some examples of aminopolycarboxylic acid ferric complex salts of which the redox potential is at least 150 mV are indicated below:

| No. | Compound | Redox Potential (vs NHE, pH = 6, mV) |
|---|---|---|
| C-1 | N-(2-Acetamido)iminodiacetic acid ferric complex salt | 180 |
| C-2 | Methyliminodiacetic acid ferric complex salt | 200 |
| C-3 | Iminodiacetic acid ferric complex salt | 210 |
| C-4 | 1,4-butylenediaminetetraacetic acid ferric complex salt | 230 |
| C-5 | Diethylenethioetherdiaminetetraacetic acid ferric complex salt | 230 |
| C-6 | glycoletherdiaminetetraacetic acid ferric complex salt | 240 |
| C-7 | 1,3-Propylenediaminetetraacetic acid ferric complex salt | 250 |

The redox potential is at least 150 mV, preferably at least 180 mV, and more preferably at least 200 mV in the present invention.

Use of Compound C-7, 1,3-propylenediaminetetraacetic acid ferric complex salt (referred to hereinafter as 1,3-PDTA.Fe(III) is especially preferred in the present invention. (This is the same compound as the 1,3-diaminopropanetetraacetic acid ferric complex salt disclosed in JP-A-62-222252 and JP-A-64-24253).

Moreover, the redox potential of ethylenediaminetetraacetic acid ferric complex salt (EDTA.Fe(III)) which is widely used in the industry is 110 mV, and that of diethylenetriaminepentaacetic acid ferric complex salt and trans-1,2-cyclohexanediaminetetraacetic acid ferric complex salt, for example, is 80 mV.

The amount of aminopolycarboxylic acid ferric complex salt having a redox potential of at least 150 mV used as the oxidizing agent in a bleaching solution of the present invention is preferably at least 0.10 mol per liter of the bleaching solution, more preferably at least 0.15 mol per liter of the bleaching solution and most preferably at least 0.25 mol per liter of the bleaching solution is used from the viewpoint of providing more rapid processing. However, the use of excessively high concentrations inhibits the bleaching reaction and so the upper limit for the concentration is preferably 0.7 mol per liter. The aminopolycarboxylic acid ferric complex salt of which the redox potential is at least 150 mV is a sodium salt, a potassium salt or an ammonium salt, for example, but the use of ammonium salts is preferred from the viewpoint of the bleaching rate. Moreover, if the concentration of the aforementioned aminopolycarboxylic acid ferric complex salt is less than 0.10 mol/liter, the bleaching rate becomes very slow. Hence, a concentration of at least 0.10 mol/liter is preferred in the present invention.

Mixtures of two or more of these aminopolycarboxylic acid ferric complex salts can be used in a bleaching solution of the present invention. In such a case the total amount should be within the concentration range indicated above. Furthermore, other aminopolycarboxylic acid ferric complex salts of which the redox potential is less than 150 mV can also be used in a bleaching solution of the present invention provided that they are included in a range in which the effect of the present invention can be realized. In practice, use can be made of ethylenediaminetetraacetic acid ferric complex salts (110 mV), diethylenetriaminepentaacetic acid ferric complex salts (80 mV) and trans-1,2-cyclohexanediaminetetraacetic acid ferric complex salts (80 mV).

However, the amount used is preferably not more than 0.5 mol per mol of the bleaching agent of which the oxidation potential is at least 150 mV.

Moreover, when the aminopolycarboxylic acid ferric complex salt is used as a bleaching agent it can be added in the form of a complex salt as aforementioned, or the complex salt can be formed in the bleaching solution by including the aminopolycarboxylic acid and a ferric salt (for example, ferric sulfate, ferric chloride, ferric nitrate, ferric ammonium sulfate, ferric phosphate) which together form the complex salt.

A slight excess of aminopolycarboxylic acid over the amount required to form the complex salt with the ferric ion may be added to a bleaching solution of the present invention, and when such an excess amount is added, an excess in the range from 0.01 to 10 mol% is generally preferred.

The pH of the bleaching solution in the present invention is generally not more than 5.0, preferably in the range of from 2.0 to 5.0, more preferably in the range of from 2.5 to 4.5 and most preferably in the range of from 3.0 to 4.0.

The use of known acids is preferred in the bleaching solution of the present invention for inhibiting bleaching fogs and for pH control. Here, the term "acid" signifies an acid other than the aminopolycarboxylic acid and its salts and its iron complex salts. Known acids are preferably acids which have a pKa value (the log value of the reciprocal of the acid dissociation constant obtained at an ion strength of 0.1 mol/liter at 25° C) of from 2.0 to 5.5, and they may be inorganic acids such as phosphoric acid or organic acids such as acetic acid, malonic acid or citric acid, for example, but the organic acids are preferred. Furthermore, among these organic acids, those which have a carboxyl group are especially preferred.

The organic acid which has a pKa value of from 2.0 to 5.5 may be a monobasic acid or a polybasic acid. The monobasic acids are preferred. In the case of a polybasic acid use can be made of a metal salt (for example, a sodium salt or a potassium salt) or an ammonium salt provided that the pKa value is in the above mentioned range of from 2.0 to 5.5. Furthermore, mixtures of two or more organic acids having a pKa of from 2.0 to 5.0 can also be used.

Preferred examples of organic acids having a pKa of from 2.0 to 5.5 which can be used in the present invention include aliphatic monobasic acids such as formic acid, acetic acid, monochloroacetic acid, monobromoacetic acid, glycolic acid, propionic acid, monochloropropionic acid, lactic acid, pyruvic acid, acrylic acid, butyric acid, isobutyric acid, pivalic acid, aminobutyric acid, valeric acid and isovaleric acid; aminoacid based compounds such as asparagine, alanine, arginine, ethionine, glycine, glutamine, cysteine, serine, methionine and leucine; monobasic aromatic acids such as benzoic acid and mono-substituted benzoic acids (e.g., chloro- or hydroxy-substituted benzoic acids), and nicotinic acid; aliphatic dibasic acids such as oxalic acid, malonic acid, succinic acid, tartaric acid, malic acid, maleic acid, fumaric acid, oxaloacetic acid, glutaric acid and adipic acid; dibasic amino acid such as asparagic acid, glutamic acid, glutaric acid, cystine and ascorbic acid; dibasic aromatic acids such as phthalic acid and terephthalic acid; and polybasic acids such as citric acid.

From among these acids, the monobasic acids which have a carboxyl group are preferred in the present invention, and the use of acetic acid, glycolic acid, hydroxyacetic acid or lactic acid either individually or in combinations is especially preferred. The conjoint use of acetic acid and glycolic acid or acetic acid and lactic acid is most preferred. Furthermore, the organic acids of the present invention do not include the aminopolycarboxylic acid ferric complex salts which are the bleaching agents.

The amount of these acids used in the present invention differs according to the type of acid but is suitably from 0.8 to 2.5 mol per liter of the bleaching solution. The amount used is preferably from 1.2 mol to 2.5 mol per liter of the bleaching solution, and more preferably from 1.5 mol to 2.0 mol per liter of the bleaching solution.

Various bleaching accelerators can be added to a bleaching solution of the present invention.

Examples of bleaching accelerators which can be used include the compounds which have a mercapto group or a disulfide group disclosed in U.S. Pat. 3,893,858, West German Patent 1,290,812, British Patent 1,138,842, JP-A-53-95630 and *Research Disclosure*, No. 17129 (July, 1978); the thiazolidine derivatives disclosed in JP-A-50-140129; the thiourea derivatives disclosed in U.S. Pat. No. 3,706,651; the iodides disclosed in JP-A-58-16235; the polyethylene oxides disclosed in West German Patent 2,748,430; and the polyamine compounds disclosed in JP-B-45-8836 (the term "JP-B" as used herein refers to an "examined Japanese patent publication"). The mercapto compounds such as those disclosed in British Patent 1,138,842 are especially preferred.

As well as the bleaching agent and the aforementioned compounds, rehalogenating agents such as bromides (for example, potassium bromide, sodium bromide and ammonium bromide), or chlorides (for example, potassium chloride, sodium chloride and ammonium chloride) can be included in a bleaching solution as used in the present invention. The use of ammonium bromide among these compounds is preferred. The concentration of the rehalogenating agent is generally from 0.1 to 5 mol, and preferably from 0.5 to 3 mol, per liter of the bleaching solution.

Furthermore, the use of ammonium nitrate as a metal corrosion inhibitor is preferred. Furthermore, any of the known additives which are added to conventional bleaching solutions can be added to the bleaching solution of the present invention within the range where the effect of the present invention can be realized.

The replenishment rate of the bleaching solution of the present invention is generally not more than 200 ml, preferably from 5 to 200 ml, and more preferably from 10 ml to 140 ml, per square meter of the photosensitive material.

The bleach processing time is generally not more than 120 seconds, preferably not more than 60 seconds, and more preferably not more than 40 seconds.

Moreover, during processing, the bleaching solution is preferably aerated and the ferrous complex salt which is being produced is oxidized to the ferric complex salt. Furthermore, similar aeration can be carried out for the bleach-fixing solution.

The fixing solution is described below.

Moreover, the term "fixing solution" in the present invention signifies the fixing solution in the fixing bath and the replenisher for this fixing solution.

The main components of the fixing solution in the present invention are a fixing agent and an aminopolycarboxylic acid, of which the redox potential of the ferric complex salt is less than 150 mV, or a salt thereof, and the pH is at least 6.5.

Thiosulfates such as sodium thiosulfate, ammonium thiosulfate, ammonium sodium thiosulfate and potassium thiosulfate; thiocyanates such as sodium thiocyanate; ammonium thiocyanate and potassium thiocyanate, thiourea and thioethers, for example, can be used as the fixing agent which is used in the fixing solution of the present invention. The use of ammonium thiosulfate among these fixing agents is preferred. The amount of fixing agent is generally from 0.3 to 3 mol, and preferably from 0.5 to 2 mol, per liter of the fixing solution.

Furthermore, the conjoint use of the aforementioned ammonium thiocyanate, thiourea and thioethers (for example, 2,6-dithia-1,8-octanediol) is preferred from the viewpoint of accelerated fixing, and the amount of these compounds which is used conjointly is generally of the order of from 0.01 mol to 0.1 mol per liter of the fixing solution but, depending on the particular case, a greater increase in fix-accelerating effect can be realized by the use of generally from 1 to 3 mol.

The aminopolycarboxylic acid or salt thereof which is included in the fixing solution is a compound whose corresponding ferric complex salt has a redox potential of less than 150 mV. This redox potential can be determined using the method described earlier. Aminopolycarboxylic acids whose corresponding ferric complex salt has a redox potential of not more than 110 mV are preferred.

Some examples of these aminopolycarboxylic acids and salts thereof are indicated below:

A-1 Ethylenediaminetetraacetic acid
A-2 Ethylenediaminetetraacetic acid disodium salt
A-3 Ethylenediaminetetraacetic acid diammonium salt
A-4 Ethylenediaminetetraacetic acid tetra(trimethylammonium) salt
A-5 Ethylenediaminetetraacetic acid tetrapotassium salt
A-6 Ethylenediaminetetraacetic acid tetrasodium salt
A-7 Ethylenediaminetetraacetic acid trisodium salt
A-8 Diethylenetriaminepentaacetic acid
A-9 Diethylenetriaminepentaacetic acid pentasodium salt
A-10 Ethylenediamine-N-(β-oxyethyl)-N,N',N'-triacetic acid
A-11 Ethylenediamine-N-(β-oxyethyl)-N,N',N'-triacetic acid trisodium salt
A-12 Ethylenediamine-N-(β-oxyethyl)-N,N',N'-triacetic acid triammonium salt
A-13 Nitrilotriacetic acid
A-14 Nitrilotriacetic acid trisodium salt
A-15 Nitrilotriacetic acid triammonium salt
A-16 Cyclohexanediaminetetraacetic acid
A-17 Cyclohexanediaminetetraacetic acid disodium salt
A-18 Cyclohexanediaminetetraacetic acid diammonium salt
A-19 Dihydroxyethylglycine
A-20 Ethyl ether diaminetetraacetic acid
A-21 Ethylenediaminetetrapropionic acid Of course, the acid or salt thereof is not limited to these illustrative compounds. Of these compounds, A-1, A-3, A-8, A-16 and A-18 are preferred, and particularly A-1 is preferred.

In the present invention, the amount of aminopolycarboxylic acid or salt thereof in the fixing solution is determined by the concentration of aminopolycarboxylic acid of which the redox potential is at least 150 mV in the bleaching solution and the amount which is introduced into the bleach-fixing solution, and the amount of fixing solution which is introduced into the bleach-fixing solution, but the inclusion of at least an amount which is able to chelate in the bleach-fixing solution all of the iron of the aminopolycarboxylic acid ferric complex salt of which the redox potential is at least 150 mV which is introduced from the bleaching solution is preferred.

Hence, the amount used is generally at least 0.01 mol, and preferably at least 0.02 mol, per liter of bleach-fixing solution, and generally at least 0.02 mol, and preferably at least 0.03 mol, per liter of fixing solution. However, too high a concentration interferes with the fixing reaction and so an amount of not more than 0.3 mol is preferred, and an amount of not more than 0.2 mol is more preferred.

Furthermore, the ratio of the molar amount of aminopolycarboxylic acid ferric complex salt of which the redox potential is at least 150 mV in the bleaching solution which is introduced into the bleach-fixing solution to the molar amount of aminopolycarboxylic acid in the fixing solution which is introduced into the bleach-fixing solution is preferably from 3/1 to $\frac{1}{3}$, and more preferably from 2/1 to $\frac{1}{2}$.

The fixing solution and/or the bleach-fixing solution which are used in the present invention preferably contain in addition to the compounds described above at least one type of chelating agents which can be represented by formulae (II) and (III) which is indicated below, or the ammonium, sodium or potassium salts thereof, in a total amount of at least 0.02 mol/liter. The addition of these chelating agents inhibits further the occurrence of staining with aging as described earlier and has a beneficial effect.

The amount of the above mentioned chelating agents added is preferably from 0.03 to 0.2 mol/liter.

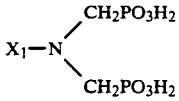
(II)

wherein $X_1$ represents a hydrogen atom, an alkyl group or an arlylene group, and preferably -L-$PO_3H_2$ or

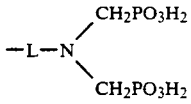

(wherein L represents an alkylene group having from 1 to 6 carbon atoms or a phenylene group and more preferably an alkylene group having from 1 to 6 carbon atoms);

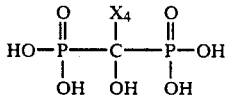
(III)

wherein $X_4$ represents an alkyl group which has from 1 to 4 carbon atoms.

Preferred examples of these compounds are indicated below, but the compounds are not limited by these examples.

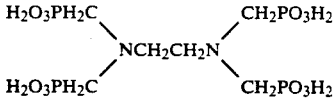
(II-1)

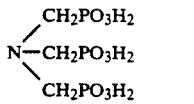
(II-2)

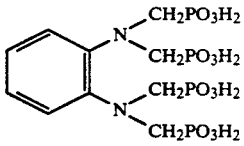
(II-3)

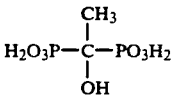
(III-1)

Among the above mentioned chelating agents, (II-1) and (III-1) are especially preferred. Furthermore, their ammonium, sodium and potassium salts, for example, are also preferred.

Sulfites (for example, sodium sulfite, potassium sulfite, ammonium sulfite, hydroxylamine, hydrazine) and bisulfite adducts of aldehyde compounds (for example, acetaldehyde/sodium sulfite) can be included as preservatives in the fixing solution. Moreover, various brightening agents and defoaming agents or surfactants, polyvinyl pyrrolidone and organic solvents such as methanol, for example, can be included, and the use of the sulfinic acid compounds disclosed in JP-A-62-143048 as preservatives is especially preferred.

The pH of the fixing solution in the present invention is at least 6.5, preferably from 6.5 to 9.0, more preferably from 6.7 to 8.0, and most preferably from 7.0 to 7.7. At least one type of compounds which have a pKa value in the range of from 6.0 to 9.0 is preferably included in the fixing solution to adjust the fixing solution into this pH region.

Compounds represented by formula (I) indicated below are preferred in the present invention as compounds having a pKa value in the range of from 6.0 to 9.0.

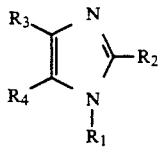
(I)

wherein $R_1$, $R_2$, $R_3$and $R_4$ each individually represents a hydrogen atom, an alkyl group or an alkenyl group.

The alkyl groups preferably have from 1 to 5 carbon atoms, and more preferably 1 or 2 carbon atoms, and they may have substituent groups, such as a hydroxy group, an amino group, a nitro group, for example. Of these alkyl groups, those which are unsubstituted are preferred, and methyl and ethyl groups are examples of the preferred groups.

The alkenyl groups preferably have from 2 to 5 carbon atoms, and more preferably 2 or 3 carbon atoms, and they may have the above mentioned substituent groups. Of these groups, the unsubstituted groups are preferred, and examples include the vinyl and allyl groups.

Among the above mentioned compounds in the present invention, $R_1$ to $R_4$ preferably represent hydrogen atoms or unsubstituted alkyl groups which have 1 or 2 carbon atoms. When there are alkyl groups present, the case in which any one of $R_1$ to $R_4$ is an alkyl group is preferred, and the case in which all of $R_1$ to $R_4$ are hydrogen atoms is the most preferred.

Actual examples of compounds which can be represented by formula (I) are indicated below, but the compounds are not limited to these examples.

(1) Imidazole
(2) 1-Methylimidazole
(3) 2-Methylimidazole
(4) 4-Methylimidazole
(5) 4-Hydroxymethylimidazole
(6) 1-Ethylimidazole
(7) 1-Vinylimidazole
(8) 4-Aminomethylimidazole
(9) 2,4-Dimethylimidazole
(10) 2,4,5-Trimethylimidazole
(11) 2-Aminoethylimidazole

(12) 2-Nitroethylimidazole

Among the compounds indicated above, (1), (2), (3), (4) and (6) are especially preferred, and (1) is the most preferred.

Compounds represented by formula (I) (imidazole compounds) are available commercially, and these compounds can be used as they are without further treatment in the present invention.

Typical examples of other compounds which have a pKa value of from 6.0 to 9.0 are indicated below.

B-1 3-[(Biscyclohexylmethyl)methylamino]propylbenzene
B-2 N-(2,2-Diphenylethyl)benzylamine
B-3 4,4-Bisdiethylaminotriphenylcarbinol
B-4 Aziridine
B-5 Octahydro-1-(1-methyl-3,3-diethyl)prop-2-enylazocine
B-6 1-tert-Butyl-octahydro-5-hydroxy-6-oxo-azonine
B-7 1-[2,3-(Albanilido)propyl]piperidine
B-8 2-Acetylimino-1,2-dihydroxy-1-methylpyridine
B-9 2-Bromo-5-sulfanilimidopyridine
B-10 1-Methyl-2-(3-pyridyl)pyrrolidine
B-11 2-Benzyl-2-pyrroline
B-12 2-Cyclohexyl-2-pyrroline
B-13 2-Ethyl-2-pyrroline
B-14 N-Acylmorpholine
B-15 N-[2-(Bis-2-hydroxypropylaminoethyl)]morpholine
B-16 N-(3,3-Diphenyl-3-propylcarbonyl)morpholine
B-17 N-(3-Ethylcarbonyl-2-methyl-3,3-diphenyl) propylmorpholine
B-18 N-Methylmorpholine
B-19 N-(3-Morpholino)propylmorpholine
B-20 1-Benzoylpiperazine
B-21 1,4-Bis(2-hydroxypropyl)piperazine
B-22 1-Ethoxycarbonyl-4-methylpiperazine
B-23 1-(p-Toluene)sulfonylpiperazine
B-24 4-Amino-5-aminomethyl-2-methylpiperazine
B-25 5-Amino-4-carboxy-6-carboxymethylamino-2-ethoxypyrimidine
B-26 5-Amino-4-(1-carboxyethylidene)iminopyrimidine
B-27 4-Amino-2,3-dihydroxymethyl-2-oxopyrimidine
B-28 4-Amino-2-hydroxy-5-nitropyrimidine
B-29 4-Amino-2-methylaminopyrimidine
B-30 5-Bromo-2,4-dihydroxypyrimidine
B-31 2,4-Diaminopyrimidine
B-32 2,4-Diamino-6-methylpyrimidine
B-33 4,5-Dihydroxy-2-methyl-1,3-triazine
B-34 2-(p-Amino)benzenesulfonamidotriazole
B-35 3-Ethyl-2,3-dihydro-2-imido-5-phenyl-1,3,4-triazole
B-36 3-Ethyl-2-ethylamino-2,3-dihydro-5-phenyl-1,3,4-triazole
B-37 2-Aminoquinoline Of course, this type of compound is not limited by these examples. Those of these compounds which have a pKa value within the range from 6.7 to 8.0 are preferred. The amount of these compounds having a pKa of from 6.0 to 9.0 which is added is the amount required to set the pH of the fixing solution to a value of 6.5 or above, and it is preferably from 0.1 to 10 mol, and more preferably from 0.2 to 3 mol, per liter of the fixing solution.

Among these components, the compounds of formula (I) are preferably included in an amount ranging from 0.2 mol to the solution limit, more preferably in an amount of from 0.2 to 2 mol, and most preferably in an amount of from 0.3 to 0.8 mol, per liter of the processing solution (i.e., the fixing solution and/or the bleach-fixing solution).

Since compounds whose pKa value is from 6.0 to 9.0 are used in the fixing solution of the present invention, the compounds are contained in the bleach-fixing solution by being carried over from the fixing solution. Accordingly, the compounds whose pKa value is from 6.0 to 9.0 may be added to the bleach-fixing solution without addition to the fixing solution. In the present invention, it is preferable that such compounds are added to both of the fixing solution and the bleach-fixing solution (i.e., the processing solution having a fixing ability).

A bleaching solution of pH 6 which contains 1,3-PDTA.Fe-(III) has been disclosed in the aforementioned JP-A-62-222252. Furthermore, the optimum pH of a bleaching solution which contains a conventional EDTA.Fe(III) complex salt is preferably in the region of 6 from the viewpoints of both ensuring the bleaching rate and preventing the occurrence of color restoration failure of the cyan dye, but such a bleaching solution has been used over a wide pH range. That is, although the bleaching rate can be improved by reducing the pH value, this gives rise to color restoration failure of the cyan dye and in the past the optimum balance has been found to be in the region of pH 6.

On the other hand, with the present invention there is a further improvement in respect of color restoration failure when the pH of the bleaching bath is reduced as described above as a result of the inclusion of a compound having a pKa value of from 6.0 to 9.0, particularly a compound which can be represented by formula (I) (an imidazole compound) in the bleach-fixing solution or fixing solution which is used in the processing operations which follow the bleaching process.

That is, the above mentioned compounds have the effect of accelerating the reaction in which the cyan leuco dye in the photosensitive material which is produced during the bleaching process is oxidized and reverts to the cyan dye and so it is thought to have a pH buffering action which rapidly raises the pH in the emulsion film of the photosensitive material and an oxidation reaction accelerating action.

Hence, in the present invention, even though the pH of the bleaching solution is low, color restoration failure does not occur since a compound of formula (I) is added to the fixing solution and/or the bleach-fixing solution and it is possible to carry out the bleaching process more quickly than was possible in the past.

In general, there are many pH buffering compounds which have the effect for retarding the fixing process. However, the compounds of formula (I) have the effect for accelerating the fixing process and rapid desilvering processing can be achieved with these compounds and, moreover, they also have the unanticipated effect of suppressing the staining which occurs with the passage of time in photosensitive materials after processing which has frequently caused problems with rapid processing.

The replenishment rate for the fixing solution is preferably from 200 ml to 3,000 ml, and more preferably from 250 ml to 1,000 ml, per square meter of the photosensitive material.

In the present invention, the method for introducing the liquid into the bleach-fixing bath may involve introducing the bleaching solution and fixing solution into the bleach-fixing bath directly from the bleaching bath and the fixing bath using pumps, respectively, or it may involve the connection of the overflow pipes from the bleaching bath and the fixing bath directly to the bleach-fixing bath and passing the overflowing liquids without modification into the bleach-fixing bath, or the overflowing liquids can be stored outside the tank and the two overflowing liquids can be introduced into the bleach-fixing bath with separate pumps. Furthermore, the two overflowing liquids may be such that bleaching solution and fixing solution which have been taken out directly with a pump, for example, from the bleaching bath and the fixing bath are mixed in an external tank and then introduced into the bleach-fixing bath with a pump, for example. Moreover, replenisher can be used conjointly with the introduction of the above mentioned bleach-fixing solution.

Furthermore, methods in which liquid is introduced into the bleach-fixing bath with pumps, for example, from the bleaching replenisher tank or the fixing replenisher tank can also be used conjointly, but in view of the pipe work required and the cost, the introduction of the overflow from the bleaching bath and the fixing bath into the bleach-fixing bath is preferred.

The amount of fixing solution introduced into the bleach-fixing bath is preferably from 200 ml to 3,000 ml, and more preferably from 250 ml to 1,000 ml, per square meter of the photosensitive material.

The amount of bleaching solution introduced into the bleach-fixing bath is preferably not more than 200 ml, and more preferably from 10 ml to 140 ml, per square meter of the photosensitive material. A bleaching agent consisting of an aminopolycarboxylic acid ferric complex salt having a redox potential of less than 150 mV in which the iron of the aminopolycarboxylic acid iron complex salt having a redox potential of at least 150 mV introduced from the bleaching solution is chelated in the bleach-fixing solution is thereby included in the bleach-fixing solution.

The amount of bleaching agent in the bleach-fixing solution is generally from 0.01 to 0.25 mol, preferably from 0.02 to 0.2 mol, and more preferably from 0.03 to 0.1 mol, per liter of the bleach-fixing solution. Furthermore, the pH of the bleach-fixing solution is preferably from 6.0 to 8.5, more preferably from 6.2 to 8.0, and most preferably from 6.2 to 7.0. It is preferable in the present invention that the pH of the bleach-fixing solution is lower than that of the fixing solution in view of the effect of the present invention and the color restoration.

In the present invention, the bleach-fixing solution (start liquor) at the commencement of processing may be prepared by mixing suitable amounts of the prepared fresh bleaching solution and fixing solution, or it may be prepared by dissolving the compounds which are used in the bleach-fixing solution as described earlier in water.

The effect of the present invention becomes more remarkable as the total processing time for the desilvering process in the present invention becomes shorter. The desilvering processing time is preferably from 1 to 4 minutes and more preferably from 1 minute and 30 seconds to 3 minutes. Furthermore, the processing temperature is preferably from 25° C. to 50° C., and more preferably from 35° C. to 45° C. In the preferred temperature range, the desilvering rate is increased and the occurrence of staining after processing is prevented effectively.

Agitation as vigorously as possible in the desilvering process is preferred for realizing the effect of the present invention.

Actual examples of forced agitation include the methods in which a jet of processing solution is directed to impinge on the emulsion surface of the photosensitive material disclosed in JP-A-62-183460 and JP-A-62-183461, the method in which the agitating effect is increased with a rotating device disclosed in JP-A-62-183461, the method in which the photosensitive material is moved with a wiper blade which is established in the solution in contact with the emulsion surface and the agitating effect is increased by the generation of turbulence at the emulsion surface, and the method in which the circulating flow rate of the whole of the processing solution is increased. Such means of increasing the level of agitation are effective for the bleaching solution, the bleach-fixing solution and the fixing solution. It is thought that the increased agitation increases the rate of supply of bleaching agent and fixing agent to the emulsion film and consequently increases the desilvering rate.

Furthermore, the aforementioned means of increasing agitation are more effective in cases where a bleaching accelerator is used, and it is possible to increase the bleach accelerating effect to a remarkable degree and to eliminate the fixing inhibiting action due to the bleaching accelerator.

The automatic processors which are used with the present invention preferably have the means of photosensitive material transport disclosed in JP-A-60-191257, JP-A-60-191258 and JP-A-60-191259. According to the disclosure in the aforementioned JP-A-60-191257, such a transporting device greatly reduces the carry-over of processing solution from the previous bath to the next bath and this is very effective for preventing any loss of processing solution performance. This type of effect is especially effective with short processing times in each process and reduced rates of replenishment of the processing solutions.

The effect of the present invention is especially pronounced when the overall development processing time is short, and in practice the present invention is clearly demonstrated when the total development processing time is 8 minutes or less, and there is a marked difference from the conventional processing method when the total development processing time is 7 minutes or less. Hence, the present invention is preferred when the total development processing time is 8 minutes or less, and it is more preferred when the total development processing time is 7 minutes or less.

Each of the processing solutions used in the desilvering process in the present invention preferably has the water which has evaporated made up automatically and the solutions are preferably supplied for processing at the optimum processing solution concentration.

In this case, the use of a system in which replenishment (replenisher replenishment) of the processing solution by supplying a replenisher and the supply of water (water replenishment) corresponding to the extent of evaporation of the processing solution when the extent of the evaporation of the processing solution reaches a specified amount are carried out conjointly is preferred.

There is no particular limitation on the actual method used for supplying the water and any method can be used for this purpose, and use can be made, for example, of the methods (1) to (3) described below.

The bleaching solution is described as a typical case in which the system described above is preferably used.

(1) A method in which a separate water monitoring tank is established with the bleaching tank and the extent of evaporation of water from the bleaching tank is calculated from the amount of water evaporating in the water monitoring tank and water is supplied to the bleaching tank in proportion with this amount of evaporation (see JP-A-1-254959 and JP-A-1-254960). At this time the water is preferably supplied in fixed quantities.

(2) A method in which the specific gravity of the bleaching solution in the bleaching tank is checked and a fixed amount of water is supplied when the specific gravity exceeds a certain value.

(3) A method in which water is supplied when the liquid surface level of the bleaching solution in the bleaching tank falls by a prescribed amount due to evaporation.

From among the methods (1) to (3) described above, the adoption of method (3) is preferred since it enables changes in the composition of the processing solution to be prevented effectively with a simple construction.

In this case, the liquid surface level is preferably detected by a level sensor and, when the level has fallen by a certain amount, the water which has been lost is made up with water.

Hence, this is preferred in terms of precision and operation a the water is generally added in fixed quantities.

In these methods, the amount of water supplied is generally from 5 to 300 ml, and preferably from 20 to 100 ml, for a bleaching tank having a capacity of from 3 to 10 liters, and the water is supplied in standard amounts, taking this amount as a standard amount of water replenishment.

This standard amount is generally from 0.001 to 2 times, preferably from 0.05 to 1 times, and more preferably from 0.1 to 0.7 times, the rate of processing solution replenishment in normal processing.

In a preferred system with replenisher replenishment and the supply of water in the present invention, the replenishment with replenisher and the supply of water are carried out, if desired, but the procedure indicated in (1) to (3) below is preferred in view of the accuracy of the pumps which are normally used for water supply and replenisher replenishment.

(1) A prescribed amount of photosensitive material is processed without replenishment with bleaching replenisher.

(2) Water compensation is made by supplying an amount of water corresponding to the fall in level when in the course of this processing without replenishment the liquid surface level of the bleaching solution falls due to evaporation and a certain liquid surface level is reached.

(3) After processing a prescribed amount of photosensitive material, the bleaching solution is replenished in a single event corresponding to the amount of processing carried out.

Preferably, water is supplied immediately beforehand when replenishing with bleaching replenisher in accordance with the prescribed amount of processing and the replenishment is carried out after the liquid surface level has been set to the standard level.

In the system described above, water is supplied when there has been a reduction of generally from about 0.05 to about 10%, and preferably of from about 0.2 to about 3%, of the bleaching solution volume at the overflow level in the bleaching tank which has a capacity of some 3 to 10 liters.

On the other hand, replenishment with replenisher is generally carried out at a rate of from about 0.1 to about 10%, and preferably of from about 0.5 to about 5% of the bleaching tank volume and at a rate of generally from about 0.1 to about 100 times, and preferably of from about 1 to about 20 times, the amount of water supplied. That is, replenishment is generally carried out when from 0.14 to 7 square meters, and preferably from 0.35 to 2.1 square meters, of the photosensitive material has been processed.

Furthermore, the number of times that water corresponding to the loss by evaporation of the bleaching solution is supplied after replenishing once and before replenishing on the next occasion under conditions where the normal amount of photosensitive material is being processing is carried out is, on average, generally from 0.1 to 10 times, and preferably from 1 to 5 times, and when the amount of material being processed is small and so-called small scale processing is being carried out then water is generally supplied from 2 to 30 times, and preferably from 5 to 20 times, during this time, while under conditions in which very large amounts of material are being processed the number of times water is supplied during this interval is generally from 0.01 to 2 times, and preferably from 0.01 to 1 times.

The system described above can also be adopted for the processes in which processing solutions which have a fixing ability are used which are carried out following the bleaching process and the system used can, in practice, be based on that described above.

Furthermore, with the processing baths which have a fixing ability the processing bath can be constructed in such a way that the washing water is introduced, and the supply of water can be carried out by introducing washing water when the liquid surface level of the processing solution has fallen until it is restored to the standard level.

Known primary aromatic amine color developing agents are included in the color developers which are used in the present invention. The p-phenylenediamine derivatives are preferred and some typical examples of these are indicated below, but the developing agent is not limited by these examples.

(D-1) N,N-Diethyl-p-phenylenediamine
(D-2) 2-Amino-5-diethylaminotoluene
(D-3) 2-Amino-5-(N-ethyl-N-laurylamino)toluene
(D-4) 4-[N-Ethyl-N-(β-hydroxyethyl)amino]aniline
(D-5) 2-Methyl-4-[N-ethyl-N-(β-hydroxyethyl)amino]-aniline
(D-6) 4-Amino-3-methyl-N-ethyl-[N-(β-methanesulfonamido) ethyl]aniline
(D-7) N-(2-Amino-5-diethylaminophenylethyl)methane-sulfonamide
(D-8) N,N-Dimethyl-p-phenylenediamine
(D-9) 4-Amino-3-methyl-N-ethyl-N-methoxyethylaniline
(D-10) 4-Amino-3-methyl-N-ethyl-N-β-ethoxyethylaniline
(D-11) 4-Amino-3-methyl-N-ethyl-N-β-butoxyethylaniline From among the above mentioned p-phenylenediamine derivatives, the illustrative Compound (D-5) is preferred.

Furthermore, these p-phenylenediamine derivatives may take the form of salts, such as sulfates, hydrochlorides, sulfites or p-toluenesulfonates, for example. The amount of the primary aromatic amine developing agent used is preferably from about 0.1 to about 20 g, and more preferably from about 0.5 to about 10 g, per liter of the color developer.

Furthermore, sulfites such as sodium sulfite, potassium sulfite, sodium bisulfite, potassium bisulfite, sodium metabisulfite and potassium metabisulfite, for example, and carbonyl sulfurous acid adducts can be added, if desired, as preservatives to the color developer.

The preferred amount of preservative is generally from 0.5 to 10 g, and more preferably from 1 to 5 g, per liter of the color developer.

The addition of various hydroxylamines, the hydroxamic acids disclosed in JP-A-63-43138, the hydrazines and hydrazides disclosed in JP-A-63-146041 and JP-A-63-170642, the phenols disclosed in JP-A-63-44657 and JP-A-63-58443, the α-hydroxyketones and α-aminoketones disclosed in JP-A-63-44656 and/or the various sugars disclosed in JP-A-63-36244 as compounds which preserve the aforementioned primary aromatic amine color developing agents directly is preferred. Furthermore, the conjoint use with the compounds mentioned above of the monoamines disclosed, for example, in JP-A-63-4235, JP-A-63-24254, JP-A-63-21647, JP-A-63-146040, JP-A-63-27841 and JP-A-63-25654; the diamines disclosed, for example, in JP-A-63-30845, JP-A-63-146040 and JP-A-63-43139; the polyamines disclosed in JP-A-63-21647 and JP-A-63-26655; the polyamines disclosed in JP-A-63-44655; the nitroxy radicals disclosed in JP-A-63-53551; the alcohols disclosed in JP-A-63-43140 and JP-A-63-53549; the oximes disclosed in JP-A-63-56654 and the tertiary amines disclosed in JP-A-63-239447 is preferred.

The various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the aromatic polyhydroxy compounds disclosed in U.S. Pat. No. 3,746,544, for example, may also be included, if desired, as other preservatives.

The color developer used in the present invention is preferably of pH from 9 to 12, and more preferably of pH from 9 to 11.0, and other already known developer components can be included in the color developer.

The use of various buffers is preferred for maintaining the above mentioned pH value.

Actual examples of buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

The amount of the buffer added to the color developer is preferably at least 0.1 mol/liter, and more preferably from 0.1 to 0.4 mol/liter.

Various chelating agents can also be used in the color developing bath as agents for preventing the precipitation of calcium and magnesium or for improving the stability of the color developing agent.

Organic compounds are preferred as the chelating agents, and examples include aminopolycarboxylic acids, organic phosphonic acids and phosphonocarboxylic acids.

Actual examples of chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, hydroxyethyliminodiacetic acid, glycol ether diaminetetraacetic acid, ethylenediamine-o-hydroxyphenylacetic acid, 2-phosphono-butane-1,2,4-tricarboxylic acid, 1-hydroxyethylidene-1,1-diphosphonic acid and N,N'-bis(2-hydroxybenzyl)ethylenediamine-N,N'-diacetic acid.

Two or more of these chelating agents can be used conjointly, if desired.

The amount of these chelating agents added should be sufficient to block the metal ions in the color developer. For example, they are used in amounts of from about 0.1 to about 10 g per liter of the color developer.

Various developing accelerators can be added to the color developer, if desired. However, the color developer in the present invention is preferably essentially free of benzyl alcohol from the viewpoints of pollution properties, solution preparation and the prevention of color staining. Here, the term "essentially free of benzyl alcohol" signifies that the concentration in the color developer is not more than 2 ml per liter of the color developer, and preferably that the developer contains no benzyl alcohol at all.

Thus, the thioether based compounds disclosed, for example, in JP-B-37-16088, JP-B-37-5987, JP-B-38-7826, JP-B-44-12380, JP-B-45-9019 and U.S. Pat. No. 3,813,247; the p-phenylenediamine based compounds disclosed in JP-A-52-49829 and JP-A-50-15554; the quaternary ammonium salts disclosed, for example, in JP-A-50-137726, JP-B-44-30074, JP-A-56-156826 and JP-A-52-43429; the amine based compounds disclosed, for example, in U.S. Pat. Nos. 2,494,903, 3,128,182, 4,230,796 and 3,253,919, JP-B-41-11431 and U.S. Pat. Nos. 2,482,546, 2,596,926 and 3,582,346; the polyalkylene oxides disclosed, for example, in JP-B-37-16088, JP-B-42-25201, U.S. Pat. No. 3,128,183, JP-B-41-11431, JP-B-42-23883 and U S. Pat. No. 3,532,501; and 1-phenyl-3-pyrazolidones and imidazoles, for example, can also be added, if desired, as developing accelerators.

Optional antifoggants can be added, if desired, in the present invention. Alkali metal halides such as sodium chloride, potassium bromide and potassium iodide, and organic antifoggants can be used for this purpose. Typical examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Brightening agents may be included in the color developer used in the present invention. The 4,4'-diamino-2,2'-disulfostilbene based compounds are preferred as brightening agents. They are added in amounts of generally from 0 to 5 g/liter, and preferably in amounts of from 0.1 to 4 g/liter.

Furthermore, various surfactants, such as alkylsulfonic acids, arylsulfonic acids, aliphatic carboxylic acids and aromatic carboxylic acids, for example, may be added, if desired.

The processing temperature in the color developer in the present invention is generally from 20° C. to 50° C., and preferably from 30° C. to 40° C. The processing time is generally from 20 seconds to 5 minutes, and preferably from 30 seconds to 3 minutes. A low replenishment rate is preferred, and a replenishment rate of from 10 to 1,500 ml per square meter of the photosensitive material is preferred, while rates of from 100 to 800 ml per square meter of the photosensitive material are even more preferred. The rate of replenishment is most preferably from 100 ml to 400 ml per square meter of the photosensitive material.

Furthermore, the color development bath can be split into two or more baths, if desired, and the color developing replenisher can be supplied to the first bath or the final bath to shorten the developing time and to reduce the replenishment rate.

Color reversal processing can also be used as the method for processing in the present invention. A developer known as a first developer which is used in the well known reversal processing of color photosensitive materials can be used for the black-and-white developer which is used in such a case. The various well known additives which are used in the black-and-white developers which are used as developers for black-and-white photosensitive materials can be included in the black-and-white first developer for a color reversal type sensitive material.

Typical additives include developing agents such as 1-phenyl-3-pyrazolidone, metol and hydroquinone; preservatives such as sulfite; accelerators comprising alkalis such as sodium hydroxide, sodium carbonate and potassium carbonate; inorganic or organic inhibitors such as potassium bromide or 2-methylbenzimidazole and methylbenzothiazole; hard water softening agents such as polyphosphoric acid; and development inhibitors such as trace quantities of iodide or mercapto compounds.

The method for processing in the present invention comprises the processing operations of color development, bleaching, bleach-fixing and fixing, etc., as described earlier. Processing operations of water washing and stabilization, for example, are generally carried out after the fixing process, but simple processing methods in which a stabilization process is carried out essentially without any water washing following the bath which has a fixing ability can also be used here.

Known additives can be included, if desired, in the washing water which is used in the water washing process. For example, use can be made of hard water softening agents such as inorganic phosphoric acids, aminopolycarboxylic acids and organic phosphoric acids, disinfectants and antifungal agents (for example, isothiazolone, organic chlorine based bactericides, benzotriazole) for preventing the propagation of various bacteria and algae, and surfactants for reducing the drying load and preventing unevenness. Furthermore, the compounds described by L. E. West in "Water Quality Criteria", *Phot. Sci. and Eng.*, Vol. 9, No. 6, pages 344 to 359 (1965), for example, can also be used.

Processing solutions which stabilize the dye image can be used for the stabilizers which are used in the stabilizing process. For example, liquids which have a buffering ability of pH 3 to 6 and liquids which contain formalin or glutaraldehyde, for example, can be used. For example, ammonium compounds, metal compounds such as Bi and Al compounds, brightening agents, chelating agents (for example, 1-hydroxyethylidene-1,1diphosphonic acid), bactericides, antifungal agents, film hardening agents, surfactants, alkanolamines, the various dye stabilizers such as the N-methylol compounds and the methods in which these are used disclosed in JP-A-2-153350 and JP-A-2-153348 and U.S. Pat. No. 4,895,574 can be used, if desired, in the stabilizer.

Furthermore, the use of a multistage countercurrent system is preferred for the water washing process or stabilizing process and the number of stages is preferably from 2 to 4. The replenishment rate is generally from 1 to 50 times, preferably from 2 to 30 times, and more preferably from 2 to 15 times, the amount of carry-over from the previous bath per unit area.

The use of deionized water in which the Ca and Mg concentrations have been reduced to not more than 5 mg/liter by means of an ion exchange resin, for example, and water which has been sterilized by means of an ultraviolet sterilizing lamp, for example, as well as town water, is preferred for the water which is used in these water washing and stabilizing processes.

When continuous processing is carried out with an automatic processor, the processing solutions become more concentrated due to evaporation in each of the processing operations of the color photosensitive material described above and this is especially so in cases where the amount of processing is small and in cases where the open area of the processing solutions is large. The supply of an appropriate amount of water or compensating liquid is preferred for correcting any such concentration of the processing solutions.

In such a case, the adoption, for example, of the methods (i) to (iii) along with water correction by the supply of water in the desilvering process described earlier is preferred.

(i) With the color developer, compensation is made by supplying water in an amount proportional to the amount of water used when supplying water to the bleaching solution.

(ii) With the washing water, water from the final stage of the water washing tank is supplied when supplying water to the processing solution which has a fixing ability as described earlier and water compensation is carried out along with the aforementioned processing solution.

(iii) With a stabilizer, water compensation is carried out by replenishing the stabilizing replenisher in proportion to the amount of water when supplying water to the processing solution which has a fixing ability.

Various other methods can also be used.

Furthermore, it is also possible to reduce the amount of effluent by using a procedure in which the overflow from the water washing process or stabilizing process is introduced into the bath which has a fixing ability which is in the tank before this process.

The photosensitive materials of the present invention should have established on a support at least one blue-sensitive layer, at least one green-sensitive layer and at least one red-sensitive layer, but no particular limitation is imposed upon the number or order of the silver halide emulsion layers and non-photosensitive layers. Typically, they are silver halide photographic materials which have, on a support, a photosensitive layer comprised of a plurality of silver halide layers which have essentially the same color sensitivity but different photographic speeds, the photosensitive layer being a unit photosensitive layer which is color-sensitive to blue light, green light or red light, and in multilayer silver halide color photographic materials, the arrangement of the unit photosensitive layers generally involves the establishment of the layers in the order, from the support side, of red-sensitive layer, green-sensitive layer, blue-sensitive layer. However, this order may be reversed, if desired, and the layers may be arranged in such a way that a layer which has a different color sensitivity is sandwiched between layers which have the same color sensitivity.

Various non-photosensitive layers, such as intermediate layers, may be established between the photosensitive silver halide layers, and uppermost and lowermost layers.

The intermediate layers may contain couplers and DIR compounds such as those disclosed in JP-A-61-43748, JP-A-59-113438, JP-A-59-113440, JP-A-61-20037 and JP-A-61-20038, and they may also contain the generally used anti-color-mixing agents, ultraviolet absorbers and antistaining agents.

The plurality of silver halide emulsion layers constituting each unit photosensitive layer is preferably a double layer structure comprising a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be established between each of the silver halide emulsion layers. Furthermore, the low speed emulsion layers may be arranged on the side furthest away from the support and the high speed emulsion layers may be arranged on the side closest to the support as disclosed, for example, in UP-A-57-112751, JP-A-62-200350, JP-A-62-206541 and JP-A-62-206543.

In practical terms, the arrangement may be, from the side furthest from the support, low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), or BH/BL/GL/GH/RH/RL, or BH/BL/GH/GL/RL/RH.

Furthermore, the layers may be arranged in the order, from the side furthest from the support, of blue-sensitive layer/GH/RH/GL/RL as disclosed in JP-B-55-34932. Furthermore, the layers may also be arranged in the order, from the side furthest away from the support, of blue-sensitive layer/GL/RL/GH/RH, as disclosed in JP-A-56-25738 and JP-A-62-63936.

Furthermore, arrangements in which there are three layers which have different speeds with the speed falling towards the support with the highest speed silver halide emulsion layer at the top, a silver halide emulsion layer which has a lower speed than the aforementioned layer as an intermediate layer and a silver halide emulsion layer which has a lower speed than the intermediate layer as a bottom layer, as disclosed in JP-B-49-15495, can also be used. In the case of structures of this type which have three layers with different speeds, the layers in a layer of the same color sensitivity may be arranged in the order, from the side furthest from the support, of intermediate speed emulsion layer/high speed emulsion layer/low speed emulsion layer, as disclosed in JP-A-59-202464.

Various layer structures and arrangements can be selected according to the purpose of the respective sensitive materials in the way described above.

All of these layer arrangements can be used in color photosensitive materials in the present invention, but color photosensitive materials of which the dry film thickness of all the structural layers except the support, the subbing layer of the support and the backing layer is not more than 20.0 μm is preferred for realizing the aims of the present invention. A dry film thickness as described above of not more than 18.0 μm is especially preferred.

The specification of film thickness is made because of the color developing agent take-up by these layers of a color photosensitive material during and after development and because of the considerable effect due to the amount of residual color developing agent on bleaching fog and the staining which occurs during image storage after processing. In particular, the occurrence of bleaching fog and staining is due to the fact that the increase in coloration of the magenta color which is thought to be due to the green-sensitive color layer is greater than the increase in coloration of the cyan and yellow colors.

Moreover, the lower limiting value for the film thickness is not subject to any particular limitation provided that the function of the sensitive material is not effectively outside the above mentioned definition but the lower limiting value for the total dry film thickness of the structural layers other than the support and the subbing layer of the support in the sensitive material is preferably 12.0 μm, and the lower limiting value for the total dry film thickness of the structural layer which is established between the photosensitive layer which is located closest to the support and the subbing layer of the support is preferably 1.0 μm.

Furthermore, reduction of the layer thickness can be achieved with the photosensitive layers or the non-photosensitive layers.

The film thickness of a multilayer color photosensitive material in the present invention is measured using the method indicated below.

The sensitive material which is to be measured is stored for 7 days after preparation under conditions of 25° C., 50% RH. First of all, the total thickness of the sensitive material is measured and then the thickness is measured again after removing the coated layers from the support and the difference is taken to be the total film thickness of the coated layers except for the support of the aforementioned sensitive material. The measurement of this thickness can be achieved using a film thickness gauge of the contact type with a voltage conversion element, for example (Anritsu Electric Co., Ltd., K-402B Stand.). Moreover, the removal of the coated layer on the support can be achieved using an aqueous solution of sodium hypochlorite.

Next, a cross sectional photograph of the above mentioned sensitive material is taken using a scanning electron microscope (magnification preferably at least 3,000 times), the total thickness and the thickness of each layer on the support is measured and the thickness of each layer can then be calculated as a proportion of the measured value of the total thickness obtained beforehand with the film thickness gauge (the absolute value of the thickness as measured).

The swelling factor [(Equilibrium swelled film thickness in water at 25° C.−Total dry film thickness at 25° C., 55% RH/Total dry film thickness at 25° C., 55%, RH)×100]of the sensitive material in the present invention is preferably from 50 to 200%, and more preferably from 70 to 150%. If the swelling factor is outside the range of numerical values indicated above the amount of residual color developing agent increases and there is an adverse effect on image quality such as photographic property and desilvering properties, and on the physical properties of the film such as the film strength.

Moreover, the film swelling rate $T\frac{1}{2}$ of a sensitive material in the present invention is defined as the time taken for the film thickness to reach half of the film thickness observed when 90% of the maximum swelled film thickness which is reached on processing for 3 minutes 15 seconds in color developer (38° C.) is taken to be the saturation film thickness. $T\frac{1}{2}$ is preferably not more than 15 seconds, and more preferably not more than 9 seconds.

The preferred silver halides included in the photographic emulsion layers of a color photosensitive material which is used in the present invention are at least one of silver iodobromides, silver iodochlorides and silver iodochlorobromides which contain 0.1 to 30 mol% of silver iodide. Most preferably they are silver iodobromides which contain from about 2 mol% to about 25 mol% of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain of the silver halide may be a very fine grain having a diameter of about 0.2 μm, or a large grain having a projected area diameter of up to about 10 μm, and the emulsion may be polydisperse emulsions or monodisperse emulsions.

Zelikman et al., in *Making and Coating Photographic Emulsions,* published by Focal Press, 1964.

The monodispersions disclosed, for example, in U.S. Pat. No. 3,574,628 and 3,655,394, and British Patent 1,413,748 are also preferred.

Furthermore, tabular grains which have an aspect ratio of at least about 5 can be used in the present invention. Tabular grains can be prepared easily using the methods described, for example, by Gutoff in *Photographic Science and Engineering,* Vol. 14, pages 248 to 257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example.

Furthermore, mixtures of grains which have various crystalline forms can be used.

In the present invention, the total amount of silver coated to the silver halide color photographic materials is generally from 3 to 20 g, preferably from 3 to 10 g, and particularly preferably from 3 to 5 g, per $m^2$ of the photographic materials.

The silver halide emulsions used have generally been subjected to physical ripening, chemical ripening and spectral sensitization. Additives which are used in such processes have been disclosed in *Research Disclosure,* Nos. 17643, 18716 and 307105, and the locations of these disclosures are summarized in the table below.

| Additives | RD 17643 (December, 1978) | RD 18716 (November, 1979) | RD 307105 (November, 1989) |
|---|---|---|---|
| 1. Chemical Sensitizers | Page 23 | Page 648, right column | Page 866 |
| 2. Sensitivity Increasing Agents | — | " | — |
| 3. Spectral Sensitizers and Supersensitizers | Paes 23–24 | Page 648,right column to page 649, right column | Pages 866–868 |
| 4. Brightening Agents | Page 24 | Page 647, right column | Page 868 |
| 5. Antifoggants and Stabilizers | Pages 24–25 | page 649, right column | Pages 868–870 |
| 6. Light Absorbers, Filter Dyes and Ultraviolet Absorbers | Pages 25–26 | Page 649, right column to page 650,left column | Page 873 |
| 7. Antistaining Agents | Page 25, right column | Page 650, left to right columns | Page 872 |
| 8. Dye Image Stabilizers | Page 25 | Page 650, left column | Page 872 |
| 9. Hardeners | Page 26 | Page 651, left column | Pages 874–875 |
| 10. Binders | Page 26 | " | Pages 873–874 |
| 11. Plasticizers and Lubricants | Page 27 | Page 650, right column | Page 876 |
| 12. Coating Aids and Surfactants | Pages 26–27 | " | Pages 875–876 |
| 13. Antistatic Agents | Page 27 | " | Pages 876–877 |
| 14. Matting Agents | — | — | Pages 878–879 |
| 15. Couplers | Page 25 | — | — |
| 16. Organic Solvents | Page 25 | — | — |

The photographic emulsions which can be used in the present invention can be prepared, for example, using the methods disclosed in *Research Disclosure (RD),* No. 17643 (December, 1978), pages 22 and 23, "I. Emulsion Preparation and Types", and *Research Disclosure,* No. 18716 (November, 1979), page 648, by P. Glafkides in *Chimie et Physique Photographique,* published by Paul Montel, 1967, by G. F. Duffin in *Photographic Emulsion Chemistry,* published by Focal Press, 1966, and by V. L.

Various color couplers can be used in the present invention, and actual examples have been disclosed in the patents cited in the aforementioned *Research Disclosure (RD),* No. 17643, sections VII-C to G.

Those disclosed, for example, in U.S. Pat. Nos. 3,933,501, 4,022,620, 4,326,024, 4,401,752 and 4,248,961, JP-B-58-10739, British Patents 1,425,020 and 1,467,760, U.S. Pat. Nos. 3,973,968, 4,314,023 and 4,511,649, and European Patent 249,473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73,636, U.S. Pat. Nos. 3,061,432 and 3,725,064, *Research Disclosure,* No. 24220 (June, 1984), JP-A-60-33552, *Research Disclosure,* No. 24230 (June, 1984), JP-A-60-43659, JP-A-61-72238, JP-A60-35730, JP-A-55-118034, JP-A-60-185951, U.S. Pat. Nos. 4,500,630, 4,540,654 and 4,556,630, and International Patent WO (PCT) 88/04795 are especially preferred.

Phenol and naphthol based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121,365A and 249,453A, U.S. Pat. Nos. 3,446,622, 4,333,999, 4,743,871, 4,451,559, 4,427,767, 4,690,889, 4,254,212 and 4,296,199, and JP-A-61-42658 are preferred.

The colored couplers for correcting the unwanted absorptions of colored dyes disclosed, for example, in section VII-G of *Research Disclosure,* No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent disclosed in U.S. Pat. No.4,777,120 is also preferred.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

Typical examples of polymerized dye forming couplers have been disclosed, for example, in U.S. Pat. Nos. 3,451,820, 4,080,211, 4,367,282, 4,409,320 and 4,576,910, and British Patent 2,102,173.

The use of couplers which release photographically useful residual groups on coupling is preferred in the present invention. The DIR couplers which release development inhibitors disclosed in the patents cited in section VII-F of the aforementioned *Research Disclosure,* No. 17643, JP-A-57-151944, JP-A-57-154234, JP-A-60-184248, JP-A-63-37346, and U.S. Pat. Nos. 4,248,962 and 4,782,012 are preferred.

The couplers disclosed in British patents 2,097,140 and 2,131,188, JP-A-59-157638 and JP-A-59-170840 are preferred as couplers which release nucleating agents or developing accelerators in the form of the image during development.

Other compounds which can be used in photosensitive materials of the present invention include the competitive couplers disclosed, for example, in U.S. Pat. No. 4,130,427; the multiequivalent couplers disclosed, for example, in U.S. Pat. Nos. 4,283,472, 4,338,393 and 4,310,618; the DIR redox compounds releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patent 173,302A, the bleaching accelerator releasing couplers disclosed, for example, in *Research Disclosure,* No. 11449, ibid., No. 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The couplers which are used in the present invention can be introduced into the photosensitive material using various known methods of dispersion.

Examples of high boiling point solvents which can be used in the oil-in-water dispersion method have been disclosed, for example, in U.S. Pat. No. 2,322,027, and actual examples of high boiling point organic solvents which have a boiling point of at least 175° C. at normal pressure which can be used in the oil-in-water dispersion method include phthalic acid esters (for example, dibutyl phthalate, dicyclohexyl phthalate, di-2-ethylhexyl phthalate, decyl phthalate, bis(2,4-di-tert-amylphenyl) phthalate, bis(2,4-di-tert-amylphenyl) isophthalate and bis(1,1-diethylpropyl) phthalate), phosphate or phosphonate esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexyl phenyl phosphonate), benzoic acid esters (for example, 2-ethylhexyl benzoate, dodecyl benzoate and 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenyl), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tert-octylaniline) and hydrocarbons (for example, paraffins, dodecylbenzene and diisopropylnaphthalene). Furthermore, organic solvents which have a boiling point of at least about 30° C., and preferably of at least 50° C., but below about 160° C., can be generally used as auxiliary solvents, and typical examples of these solvents include ethyl acetate, butyl acetate, ethyl propionate, methyl ethyl ketone, cyclohexanone, 2-ethoxyethyl acetate and dimethylformamide.

Actual examples of the processes and effects of the latex dispersion method and of latexes for loading purposes have been disclosed, for example, in U.S. Pat. No. 4,199,363, and West German Patent Application (OLS) Nos. 2,541,274 and 2,541,230.

Furthermore, these couplers can be impregnated onto a loadable latex in the presence or absence of the aforementioned high boiling point organic solvents (for example, U.S. Pat. No. 4,203,716), or they can be dissolved in a water-insoluble but organic solvent-soluble polymer and emulsified and dispersed in an aqueous hydrophilic colloid solution.

Furthermore, use of the homopolymers or copolymers disclosed on pages 12 to 30 of the specification of International Patent W088/00723 is preferred. The use of acrylamide based polymers is especially preferred from the viewpoint of dye stabilization.

Various color photosensitive materials can be used in the present invention. The application of the present invention to general purpose and cinematographic color negative films and color reversal films for slides and television purposes is especially preferred.

Suitable supports which can be used in the present invention have been described on page 28 of *Research*

*Disclosure,* No. 17643 and from the right hand column on page 647 to the left hand column of page 648 of *Research Disclosure,* No. 18716.

ILLUSTRATIVE EXAMPLES

The present invention is described in detail below by means of illustrative examples, but the present invention is not limited by these examples. Unless otherwise specified, all percents, ratios, parts, etc., are by weight.

EXAMPLE 1

The layers of which the compositions are indicated below were coated on an undercoated cellulose triacetate film and Sample 101, a multilayer photosensitive material, was obtained.

Photosensitive Layer Composition

The numerical value corresponding to each component indicates the coated weight in units of $g/m^2$. However, in the case of silver halides and colloidal silver the coated amount is indicated in units of $g/m^2$ calculated as silver, and in the case of the sensitizing dyes, the coated amount is indicated in units of mol per mol of silver halide in the same layer.

Sample 101

| | |
|---|---|
| First Layer (Antihalation Layer, Film Thickness: 1.2 μm) | |
| Black Colloidal Silver | 0.18 as silver |
| Gelatin | 1.50 |
| Second Layer (Intermediate Layer, Film Thickness: 1.7 μm) | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.40 |
| Third Layer (First Red-Sensitive Emulsion Layer, Film Thickness: 1.5 μm) | |
| Emulsion A | 0.25 as silver |
| Emulsion B | 0.25 as silver |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| EX-2 | 0.170 |
| EX-10 | 0.020 |
| EX-15 | 0.160 |
| HBS-1 | 0.060 |
| Gelatin | 1.20 |
| Fourth Layer (Second Red-Sensitive Emulsion Layer, Film Thickness: 2.0 μm) | |
| Emulsion G | 1.0 as silver |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| EX-2 | 0.210 |
| EX-3 | 0.050 |
| EX-10 | 0.015 |
| EX-15 | 0.190 |
| HBS-1 | 0.060 |
| Gelatin | 1.55 |
| Fifth Layer (Third Red-Sensitive Emulsion Layer, Film Thickness: 2.4 μm) | |
| Emulsion D | 1.6 as silver |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |

-continued

| | |
|---|---|
| HBS-1 | 0.22 |
| HBS-2 | 0.10 |
| Gelatin | 1.85 |
| Sixth Layer (Intermediate Layer, Film Thickness: 1.0 μm) | |
| EX-5 | 0.040 |
| HBS-1 | 0.020 |
| Gelatin | 1.15 |
| Seventh Layer (First Green-Sensitive Emulsion Layer, Film Thickness: 1.5 μm) | |
| Emulsion A | 0.15 as silver |
| Emulsion B | 0.15 as silver |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.100 |
| EX-14 | 0.250 |
| EX-1 | 0.021 |
| EX-7 | 0.030 |
| EX-8 | 0.025 |
| HBS-1 | 0.300 |
| HBS-3 | 0.010 |
| Gelatin | 0.90 |
| Eighth Layer (Second Green-Sensitive Emulsion Layer, Film Thickness: 1.0 μm) | |
| Emulsion C | 0.45 as silver |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.060 |
| EX-14 | 0.053 |
| EX-8 | 0.018 |
| EX-7 | 0.026 |
| HBS-1 | 0.160 |
| HBS-3 | 0.008 |
| Gelatin | 0.70 |
| Ninth Layer (Third Green-Sensitive Emulsion Layer, Film Thickness: 2.2 μm) | |
| Emulsion E | 1.2 as silver |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.75 |
| Tenth Layer (Yellow Filter Layer, Film Thickness: 1.0 μm) | |
| Yellow Colloidal Silver | 0.05 as silver |
| EX-5 | 0.08 |
| HBS-1 | 0.03 |
| Gelatin | 1.10 |
| Eleventh Layer (First Blue-Sensitive Emulsion Layer, Film Thickness: 2.0 μm) | |
| Emulsion A | 0.08 as silver |
| Emulsion B | 0.07 as silver |
| Emulsion F | 0.07 as silver |
| Sensitizing Dye VIII | $3.5 \times 10^{-4}$ |
| EX-9 | 0.721 |
| EX-8 | 0.042 |
| HBS-1 | 0.28 |
| Gelatin | 1.25 |
| Twelfth Layer (Second Blue-Sensitive Emulsion Layer, Film Thickness: 1.1 μm) | |
| Emulsion G | 0.45 as silver |
| Sensitizing Dye VIII | $2.1 \times 10^{-4}$ |
| EX-9 | 0.154 |
| EX-10 | 0.007 |
| HBS-1 | 0.05 |
| Gelatin | 0.95 |
| Thirteenth Layer (Third Blue-Sensitive Emulsion Layer, Film Thickness: 1.2 μm) | |
| Emulsion H | 0.77 as silver |
| Sensitizing Dye VIII | $2.2 \times 10^{-4}$ |
| EX-9 | 0.20 |
| HBS-1 | 0.07 |
| Gelatin | 0.90 |
| Fourteenth Layer (First Protective Layer, | |

-continued

| Film Thickness: 1.5 μm) | |
|---|---|
| Emulsion I | 0.5 as silver |
| U-4 | 0.11 |
| U-5 | 0.17 |
| HBS-1 | 0.05 |
| Gelatin | 1.30 |
| Fifteenth Layer (Second Protective Layer, Film Thickness: 2.0 μm) | |

-continued

| | |
|---|---|
| Poly(methyl methacrylate) Particles (diameter: about 1.5 μm) | 0.54 |
| S-1 | 0.20 |
| Gelatin | 1.25 |

Gelatin Hardening Agent H-1 and surfactant were added to each layer in addition to the compounds indicated above.

| | Average AgI Content (%) | Average Grain Size (μm) | Variation Coefficient of Grain Size (%) | Diameter/ Thickness Ratio | Silver Ratio (AgI Content) |
|---|---|---|---|---|---|
| Emulsion A | 4.1 | 0.45 | 27 | 1 | Core/Shell = 1/3 (13/1) Double Structure Grains |
| Emulsion B | 8.9 | 0.70 | 14 | 1 | Core/Shell = 3/7 (25/2) Double Structure Grains |
| Emulsion C | 10.0 | 0.75 | 30 | 2 | Core/Shell = 1/2 (24/3) Double Structure Grains |
| Emulsion D | 16.0 | 1.05 | 35 | 2 | Core/Shell = 1/2 (40/0) Double Structure Grains |
| Emulsion E | 10.0 | 1.05 | 35 | 3 | Core/Shell = 1/2 (24/3) Double Structure Grains |
| Emulsion F | 4.1 | 0.25 | 28 | 1 | Core/Shell = 1/3 (13/1) Double Structure Grains |
| Emulsion G | 13.6 | 0.75 | 25 | 2 | Core/Shell = 1/2 (40/0) Double Structure Grains |
| Emulsion H | 14.0 | 1.30 | 25 | 3 | Core/Shell = 37/63 (34/3) Double Structure Grains |
| Emulsion I | 1.0 | 0.07 | 15 | 1 | Uniform Grains |

EX-1

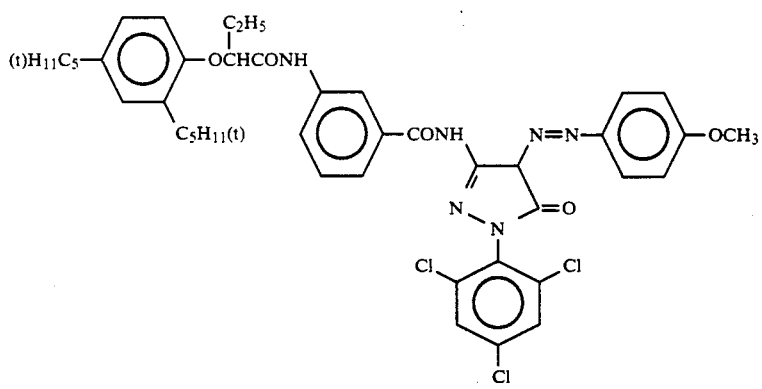

EX-2

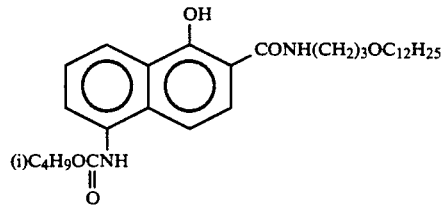

EX-3

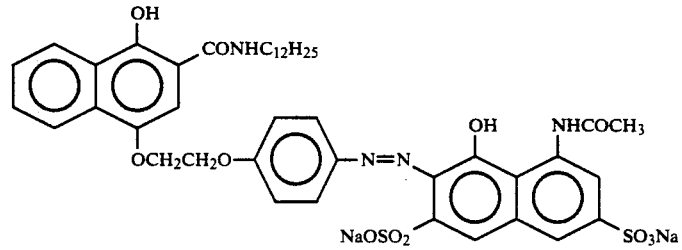

-continued
EX-4
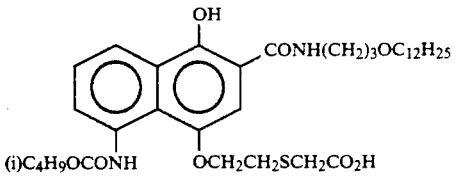
EX-5
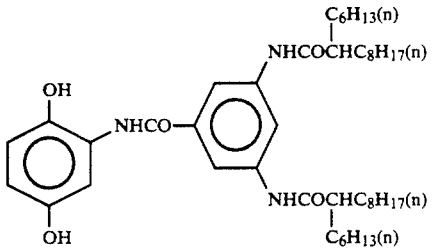
EX-6
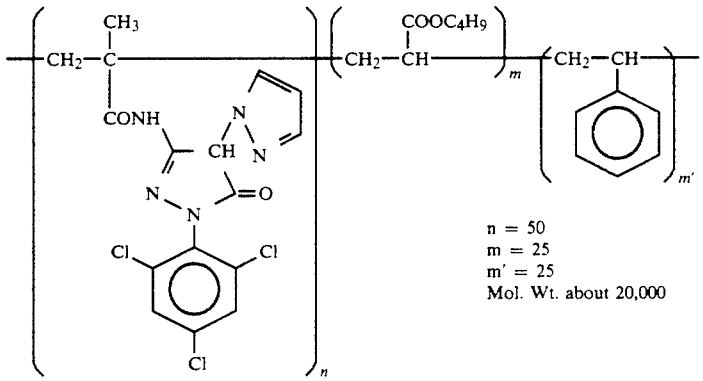
EX-7
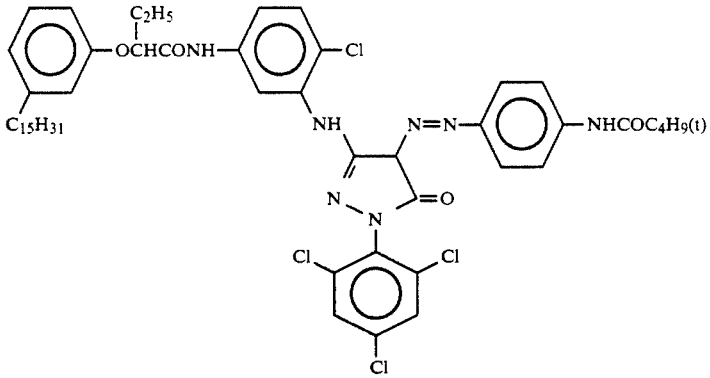
EX-8
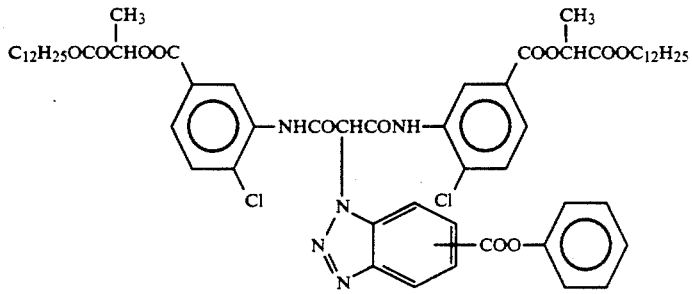

-continued
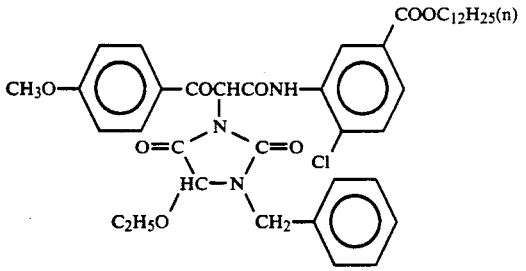
EX-9
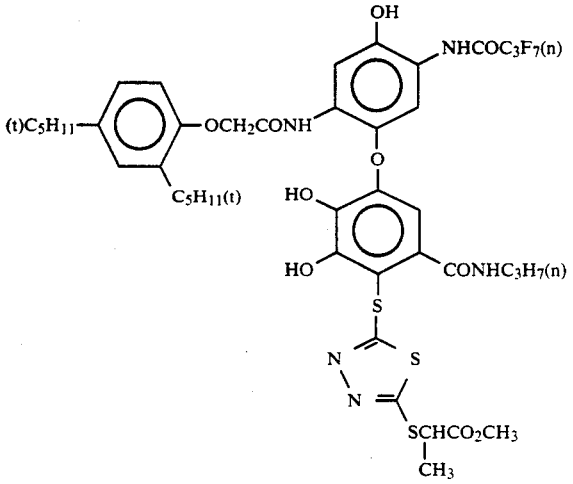
EX-10
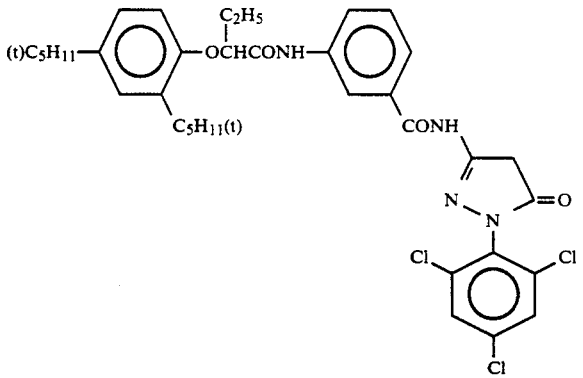
EX-11
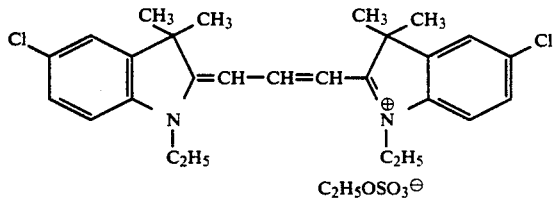
EX-12

-continued
EX-13
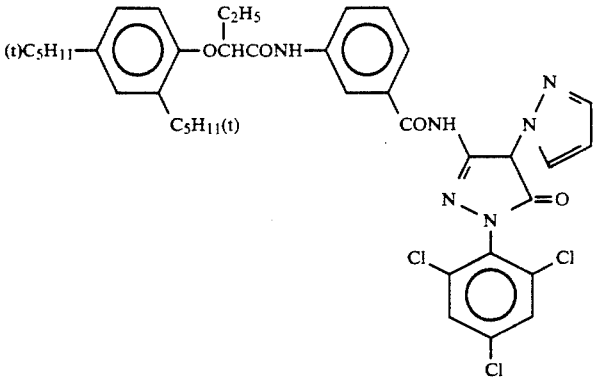
EX-14
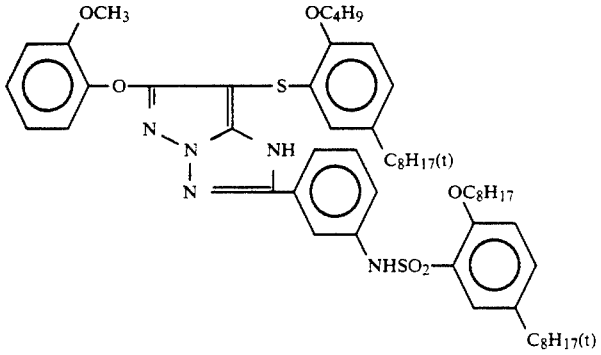
EX-15
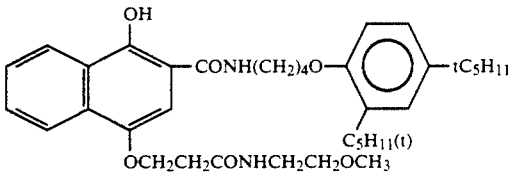
U-1
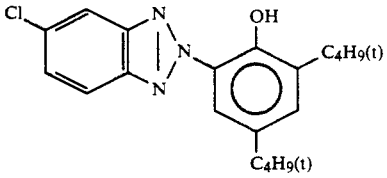
U-2
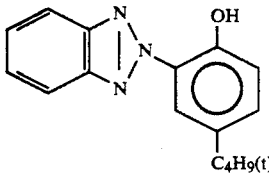
U-3
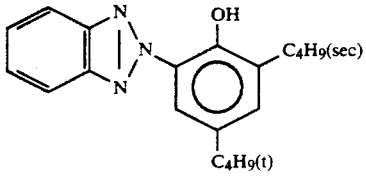

-continued
U-4
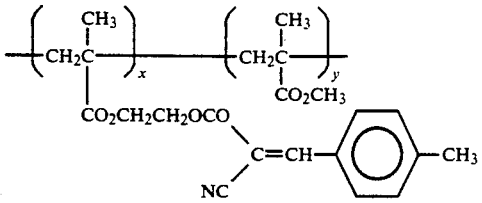
x/y = 70/30 (wt %)
UV-5
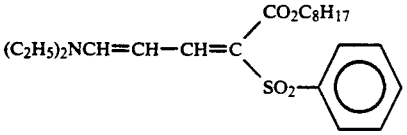
Tricresyl phosphate — HBS-1
Di-n-butyl phthalate — HBS-2
HBS-3
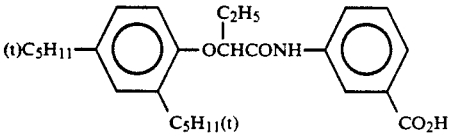
Sensitizing Dye I
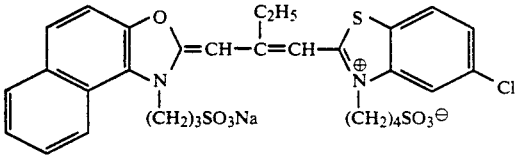
Sensitizing Dye II
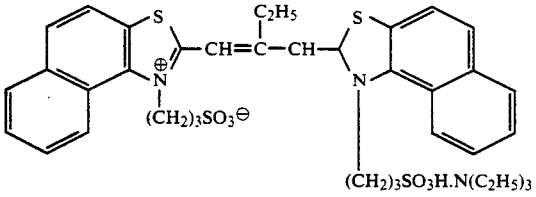
Sensitizing Dye III
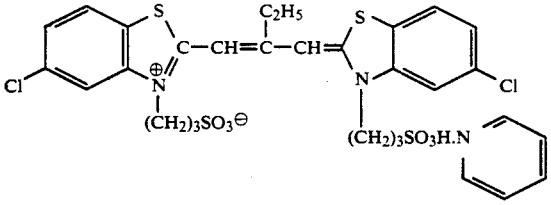
Sensitizing Dye V
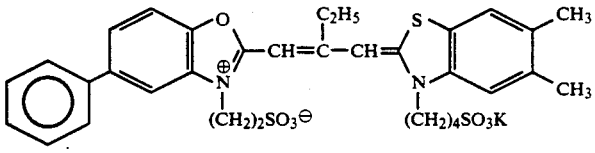
Sensitizing Dye VI
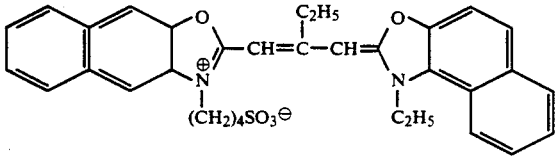

-continued

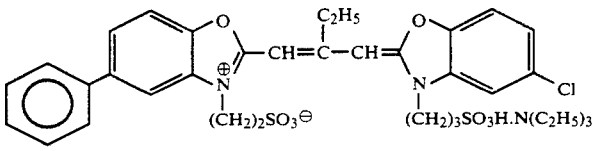

Sensitizing Dye VII

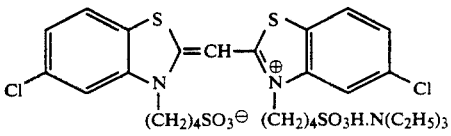

Sensitizing Dye VIII

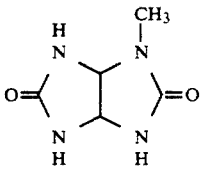

S-1

$CH_2{=}CH{-}SO_2{-}CH_2{-}CONH{-}CH_2$
$CH_2{=}CH{-}SO_2{-}CH_2{-}CONH{-}CH_2$

H-1

The dry film thickness of all the coated layers excluding the support and the subbing layer of the support in Sample 101 prepared on this occasion was 23.5 μm.

The sample prepared was cut and finished to a width of 35 mm and exposed through a wedge using white light (color temperature of the light source: 4,800° K.) in such a way that the exposure in the maximum density part was 5 CMS and then it was processed in a negative type automatic processor using the processing operations described below. However, the samples evaluated in terms of performance were processed after processing samples which had been subjected to an imagewise exposure continuously using the processing operations described below.

In processing operation (1), the fixing solution was replenished with a countercurrent system from fixing (2) to fixing (1), the water washing water was replenished with a countercurrent system from water washing (2) to water washing (1) and all of the overflow from the water washing was introduced into fixing (2).

| Process | Processing Operation (2) Processing Time | Processing Temperature (°C.) | Replenishment Rate* (ml) | Tank Capacity (liter) |
|---|---|---|---|---|
| Color Development | 3 min 15 sec | 38.0 | 23 | 15 |
| Bleaching | 45 sec | 38.0 | 5 | 5 |
| Bleach-Fixing | 45 sec | 38.0 | — | 5 |
| Fixing | 45 sec | 38.0 | 15 | 5 |
| Water Washing (1) | 20 sec | 38.0 | — | 5 |
| Water Washing (2) | 20 sec | 38.0 | 30 | 5 |
| Stabilization | 20 sec | 38.0 | 20 | 5 |
| Drying | 1 min | 55 | — | — |

*Replenishment rate per meter of 35 mm wide sample.

In processing operation (2), the water washing water was replenished with a countercurrent system from water washing (2) to water washing (1). All of the overflow from the water washing was introduced into the fixing bath. Replenishment (feed) to the bleach-fixing bath was achieved by connecting the top part of the bleaching tank of the automatic processor to the bottom part of the bleach-fixing tank and top part of the fixing

| Process | Processing Operation (1) Processing Time | Processing Temperature (°C.) | Replenishment Rate* (ml) | Tank Capacity (liter) |
|---|---|---|---|---|
| Color Development | 3 min 15 sec | 38.0 | 23 | 15 |
| Bleaching | 45 sec | 38.0 | 5 | 5 |
| Fixing (1) | 45 sec | 38.0 | — | 5 |
| Fixing (2) | 45 sec | 38.0 | 15 | 5 |
| Water Washing (1) | 20 sec | 38.0 | — | 5 |
| Water Washing (2) | 20 sec | 38.0 | 30 | 5 |
| Stabilization | 20 sec | 38.0 | 20 | 5 |
| Drying | 1 min | 55 | — | — |

*Replenishment rate per meter of 35 mm wide sample.

tank to the bottom of the bleach-fixing tank with pipes and operating the system in such a way that all of the overflow produced by replenishing the bleaching bath and the fixing bath was introduced into the bleach-fixing bath. Moreover, the amount of carry-over of developer to the bleaching process, the amount of carry-over of bleaching solution to the bleach-fixing process, the amount of carry-over of bleach-fixing solution to the fixing process and the amount of carry-over of fixing solution to the water washing process was 2.5 ml, 2.0 ml, 2.0 ml and 2.0 ml per meter length of the color photosensitive material of width 35 mm, respectively. Furthermore, the crossover time was 5 seconds in each case and this time is included in the processing time of the preceding operation.

Moreover, the bleaching tank, the bleach-fixing tank and the fixing tank each had an open factor of 0.02.

Furthermore, IWAKI magnetic pumps were used for agitation in the automatic processor used for processing and jet flow from holes of diameter 1.2 mm from the outside to the inside of the rack was achieved onto the emulsion surface of the photosensitive material at a distance of about 10 mm.

The size and flow rate of the pump used in each tank and the number of blow-out holes in each tank was as indicated below.

| Process | Pump | Flow Rate (liter/min) | Number of Blow-Out Holes |
|---|---|---|---|
| Color Development | MD-20 | 15 | 54 |
| Bleaching | MD-20 | 15 | 54 |
| Bleach-Fixing | MD-20 | 15 | 54 |
| Fixing | MD-20 | 15 | 54 |
| Water Washing (1) | MD-10 | 8 | 36 |
| Water Washing (2) | MD-10 | 8 | 36 |
| Stabilization | MD-10 | 8 | 36 |

Furthermore, the supply of water to each processing tank and the replenishment with replenishers was carried out in the way described below.

The above mentioned sample was processed continuously for 1 month under conditions of low temperature and humidity at 15° C., 20% RH at a rate of 20 m (0.7 $m^2$) per day.

In this case, 30 m of the photosensitive material (Sample 101) were processed without replenishment, the liquid surface levels were detected by level sensors which had been established in each of the bleaching, bleach-fixing and fixing tanks and when evaporation occurred and there was a fall from the standard level ($L_0$) to a fixed level ($L_1$), water could be supplied.

At this time, the replenishment rate of bleaching replenisher carried out in one shot was set at 3 times the 40 ml of water for the fall from $L_0$ to $L_1$ in the bleaching tank, and water was supplied on ten occasions during this interval.

Furthermore, the water supply pump was operated after processing 30 m of the above mentioned Sample 101, the liquid surface levels in both the above mentioned tanks were returned to $L_0$ and replenishment with bleaching replenisher corresponding to 30 m of the photosensitive material (Sample 101) as described above was carried out.

Furthermore, water was supplied to the bleach-fixing tank, the fixing tank and the water washing tank after processing every 10 m of the photosensitive material (Sample 101) and, as in the case of the bleaching solution, the level of the bleach-fixing tank and the fixing solution was detected by a level sensor which had been established in the bleach-fixing tank and the fixing tank and concentration correction for evaporation of the bleach-fixing solution, the fixing solution and the water washing water was carried out by supplying water to the last stage water washing tank to return the water level to the standard level.

Moreover, when water was supplied to the bleaching tank, water was also supplied to the color developing tank, and when water was supplied to the water washing tank, the fixing tank was also supplied with water (which is to say, water was supplied in proportion to this water supply).

Processing solution replenishment with color developing replenisher and stabilizing replenisher was carried out for every meter of photosensitive material of width 35 mm.

Moreover, the bleaching solution was aerated in the bleaching tank only during the processing of photosensitive material (Sample 101).

In processing operation (1), the amount of carry-over of the processing solution to the post process due to the photosensitive material is the same as in processing operation (2) except that the amount of carry-over of the bleaching solution to the fixing process was 2.0 ml per meter length of the color photosensitive material of width of 35 mm. Further, the crossover time, opening rate, stirring, replenishment of water, replenishment of replenisher, and aeration also are the same as in processing operation (1).

The composition of the processing solutions is indicated below.

| | Start Liquor (g) | Replenisher (g) |
|---|---|---|
| Color Developer | | |
| Diethylenetriaminepentaacetic Acid | 2.0 | 2.2 |
| 1-Hydroxyethylidene-1,1-diphosphonic Acid | 3.3 | 3.3 |
| Sodium Sulfite | 3.9 | 5.2 |
| Potassium Carbonate | 37.5 | 39.0 |
| Potassium Bromide | 1.4 | 0.4 |
| Potassium Iodide | 1.3 mg | — |
| Hydroxylamine Sulfate | 2.4 | 3.3 |
| 2-Ethyl-4-[N-ethyl-N(β-hydroxyethyl)amino]aniline Sulfate | 4.5 | 6.1 |
| Water to make | 1.0 liter | 1.0 liter |
| pH | 10.05 | 10.15 |
| Bleaching Solution | | |
| Bleaching Agent (See Table 1) | 0.37 mol | 0.52 mol |
| Ammonium Bromide | 84.0 | 120.0 |
| Ammonium Nitrate | 30.0 | 41.7 |
| Glycolic Acid | 91.0 | 130.0 |
| Acetic Acid (98 wt %) | 34.0 | 48.0 |
| Water to make | 1.0 liter | 1.0 liter |
| pH (adjusted with aqueous ammonia) | 3.2 | 2.8 |
| Fixing Solution | | |
| Imidazole | 21.0 | 63.0 |
| Aminopolycarboxylic Acid | (See Table 1) | |
| Aqueous Ammonium Thiosulfate Solution (700 g/liter) | 300.0 ml | 770.0 ml |
| Ammonium Sulfite | 15.0 | 45.0 |
| Water to make | 1.0 liter | 1.0 liter |
| pH | 7.4 | 7.4 |

Bleach-Fixing Solution (Start Liquor)

A 1/10 mixture of the start liquor of bleaching solution and the start liquor of fixing solution described above.

Water Washing Water (Start Liquor=Replenisher)

Town water was passed through a mixed bed column which had been packed with an H-type strongly acidic cation exchange resin ("Amberlite IR-120" made by Rohm & Haas Co.) and an OH-type strongly basic anion exchange resin ("Amberlite IRA-400", made by the same company) and treated in such a way that the calcium and magnesium concentrations were not more than 3 mg/liter, and then 20 mg/liter of sodium isocyanurate dichloride and 150 mg of sodium sulfate were added. The pH of this solution was within the range of from 6.5 to 7.5.

Stabilizer (Start Liquor=Replenisher)

| | |
|---|---|
| Formalin (37 wt %) | 2.0 ml |
| Polyoxyethylene p-monononylphenyl Ether (average degree of polymerization: 10) | 0.3 g |
| Ethylenediaminetetraacetic Acid Disodium Salt | 0.05 g |
| Water to make | 1.0 liter |
| pH | 5.0–8.0 |

Density measurements were made immediately after completing the processing and characteristic curves were obtained. After completing the density measurements the samples were immersed in a 5 wt % aqueous solution of ferricyanide and treated for 5 minutes at 30° C. with aeration. Subsequently, the samples were washed with a flowing water for 5 minutes and dried, after which the density measurements were repeated to obtain characteristic curves.

The exposures which gave a density of 1.0 on the characteristic curve measured with red light (R) after treatment with the aqueous ferricyanide solution was read off from these characteristic curves, the density ($D_1$) for the same exposure on the R characteristic curve before treatment with the aqueous ferricyanide was read off and the color restoration factor, D (%)=$(D_1/1.0)\times 100$, was calculated from these values. The results obtained are shown in Table 1. A low color restoration factor indicates that the fall in density due to conversion of the cyan dye to the leuco dye was considerable, which is to say that there was considerable color restoration failure. It is clear from the results obtained that there was no color restoration failure and good results were obtained when processing was carried out using the processing solutions and processing operation of the present invention.

EXAMPLE 2

Sample 101 prepared in Example 1 was cut and finished, exposed and processed in the same way as described in Example 1 except that the processing solutions indicated below were used.

| | Start Liquor (g) | Replenisher (g) |
|---|---|---|
| Color Developer | | |
| Diethylenetriaminepentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.4 |
| Potassium Iodide | 1.5 mg | — |
| Hydroxylamine Sulfate | 2.4 | 2.8 |
| 2-Methyl-4-[N-ethyl-N-(β-hydroxyethyl)amino]aniline Sulfate | 4.5 | 5.5 |
| Water to make | 1.0 liter | 1.0 liter |
| pH | 10.05 | 10.15 |
| Bleaching Solution | | |
| 1,3-Propylenediaminetetraacetic Acid Ferric Ammonium Hydrate Salt | 144.0 | 206.0 |
| 1,3-Propylenediaminetetraacetic Acid | 2.8 | 4.0 |
| Ammonium Bromide | 84.0 | 120.0 |
| Ammonium Nitrate | 30.0 | 41.7 |
| Glycolic Acid | 90.0 | 130.0 |
| Acetic Acid (98 wt %) | 34.0 | 48.0 |
| Water to make | 1.0 liter | 1.0 liter |
| pH (adjusted with 27 wt % aqueous ammonia) | See Table 2 | |

Start Liquor Bleach-Fixing Solution

A 1/10 mixture of the start liquor of bleaching solution described above and the start liquor of fixing solution described below.

| Fixing Solution | Start Liquor (g) | Replenisher (g) |
|---|---|---|
| Imidazole | 30.0 | 90.0 |
| Ethylenediaminetetraacetic Acid | 13.0 | 39.0 |
| Ammonium Thiosulfate (700 g/liter) | 280.0 ml | 840.0 ml |
| Ammonium Sulfite | 19.0 | 57.0 |
| Water to make | 1.0 liter | 1.0 liter |
| pH | See Table 2 | |

TABLE 1

| Processing No. | Processing Operation | Bleaching Agent | Fixing Solution: Aminopolycarboxylic Acid | Amount Added (mol/liter): Start Liquor | Amount Added (mol/liter): Replenisher | Restoration Factor | Remarks |
|---|---|---|---|---|---|---|---|
| 1-1 | (1) | EDTA.Fe* | A-1 | 0.05 | 0.15 | 80 | Comparison |
| 1-2 | (1) | C-7** | A-1 | 0.05 | 0.15 | 86 | Comparison |
| 1-3 | (2) | EDTA.Fe* | — | — | — | 77 | Comparison |
| 1-4 | (2) | EDTA.Fe* | A-1 | 0.05 | 0.15 | 89 | Comparison |
| 1-5 | (2) | C-7** | — | — | — | 89 | Comparison |
| 1-6 | (2) | C-7** | A-1 | 0.05 | 0.15 | 100 | Invention |
| 1-7 | (2) | C-7* | A-8 | 0.05 | 0.15 | 99 | Invention |
| 1-8 | (2) | C-7** | A-16 | 0.05 | 0.15 | 99 | Invention |
| 1-9 | (2) | C-4*** | A-1 | 0.05 | 0.15 | 98 | Invention |

*EDTA.Fe signifies an ethylenediaminetetraacetic acid ferric ammonium complex salt

**Ammonium salt monohydrate of C-7

***Ammonium salt monohydrate of C-4

Water Washing Water

Same as in Example 1.

Stabilizer

Same as in Example 1.

Processing was carried out with different pH values for the start liquor of bleaching solution and fixing solution as shown in Table 2. Moreover, the pH values of the bleaching solution and fixing solution replenishers were set in such a way that the pH of the respective start liquors was held constant. The processed samples were treated using the same manner as in Example 1 and the color restoration factors were obtained. The results obtained are shown in Table 2. It is clear from these results that the color restoration factor was good when processing was carried out under the conditions of the present invention.

TABLE 2

| Processing No. | Processing Operation | Bleaching Solution pH | Fixing Solution pH | Color Restoration Factor (%) | Remarks |
|---|---|---|---|---|---|
| 2-1 | (2) | 3 | 6 | 88 | Comparison |
| 2-2 | (2) | 3 | 6.5 | 98 | Invention |
| 2-3 | (2) | 3 | 7 | 100 | " |
| 2-4 | (2) | 3 | 8 | 100 | " |
| 2-5 | (2) | 3 | 9 | 97 | " |
| 2-6 | (1) | 3 | 9 | 84 | Comparison |
| 2-7 | (2) | 4 | 6 | 85 | " |
| 2-8 | (2) | 4 | 6.5 | 98 | Invention |
| 2-9 | (2) | 4 | 7 | 100 | " |
| 2-10 | (2) | 4 | 8 | 100 | " |
| 2-11 | (2) | 4 | 9 | 97 | " |
| 2-12 | (1) | 4 | 9 | 81 | Comparison |
| 2-13 | (2) | 5 | 6 | 81 | " |
| 2-14 | (2) | 5 | 6.5 | 95 | Invention |
| 2-15 | (2) | 5 | 7 | 98 | " |
| 2-16 | (2) | 5 | 8 | 98 | " |
| 2-17 | (2) | 5 | 9 | 94 | " |
| 2-18 | (1) | 5 | 9 | 76 | Comparison |
| 2-19 | (2) | 6 | 6 | 74 | " |
| 2-20 | (2) | 6 | 6.5 | 85 | " |
| 2-21 | (2) | 6 | 7 | 87 | " |
| 2-22 | (2) | 6 | 8 | 90 | Comparison |
| 2-23 | (2) | 6 | 9 | 84 | " |

Results for the present invention are enclosed in the frames.

EXAMPLE 3

Sample 301, a multilayer color photosensitive material comprised of the layers of which the compositions are indicated below, was prepared on an undercoated cellulose triacetate film.

Composition of the Photosensitive Layer

The coated weights are indicated in units of $g/m^2$ of Ag in the case of silver halides and colloidal silver, in units of $g/m^2$ in the case of couplers, additives and gelatin and in units of mol per mol of silver halide in the same layer in the case of the sensitizing dyes.

| | |
|---|---|
| First Layer (Antihalation Layer) | |
| Black Colloidal Silver | 0.15 as Ag |
| Gelatin | 1.5 |
| ExM-8 | 0.08 |
| UV-1 | 0.03 |
| UV-2 | 0.06 |
| Solv-2 | 0.08 |
| UV-3 | 0.07 |

-continued

| | |
|---|---|
| Cpd-5 | $6 \times 10^{-4}$ |
| Second Layer (Intermediate Layer) | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| Third Layer (First Red-Sensitive Emulsion Layer) | |
| Silver Iodobromide Emulsion (AgI: 2 mol %, high internal AgI type, corresponding sphere diameter: 0.3 μm, variation coefficient of corresponding sphere diameter: 29%, regular crystal grain/twinned crystal grain mixture, diameter/thickness ratio: 2.5) | |
| Coated amount as silver | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| Cpd-5 | $3 \times 10^{-4}$ |
| Fourth Layer (Second Red-Sensitive Emulsion Layer) | |
| Silver Iodobromide Emulsion (AgI: 4 mol %, high internal AgI type, corresponding sphere diameter: 0.55 μm, variation coefficient of corresponding sphere diameter: 20%, regular crystal grain/twinned crystal grain mixture, diameter/thickness ratio: 1) | |
| Coated amount as silver | 0.7 |
| Gelatin | 1.26 |
| ExS-1 | $1 \times 10^{-4}$ |
| ExS-2 | $3 \times 10^{-4}$ |
| ExS-3 | $1 \times 10^{-5}$ |
| ExC-3 | 0.33 |
| ExC-4 | 0.01 |
| ExY-15 | 0.01 |
| ExY-16 | 0.01 |
| ExC-7 | 0.04 |
| ExC-2 | 0.08 |
| Solv-1 | 0.03 |
| Cpd-5 | $5 \times 10^{-4}$ |
| Fifth Layer (Third Red-Sensitive Emulsion Layer) | |

-continued

| | |
|---|---|
| Silver Iodobromide Emulsion (AgI: 10 mol %, high internal AgI type, corresponding sphere diameter: 0.7 μm, variation coefficient of corresponding sphere diameter: 30%, twinned crystal grain mixture, diameter/thickness ratio: 2) | |
| Coated amount as silver | 0.7 |
| Gelatin | 0.8 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| Sixth Layer (Intermediate Layer) | |
| Gelatin | 1.0 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| Seventh Layer (First Green-Sensitive Emulsion Layer) | |
| Silver Iodobromide Emulsion (AgI: 2 mol %, high internal AgI type, corresponding sphere diameter: 0.3 μm, variation coefficient of corresponding sphere diameter: 28%, regular crystal grain/twinned crystal grain mixture, diameter/thickness ratio: 2.5) | |
| Coated amount as silver | 0.30 |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.2 |
| Cpd-5 | $2 \times 10^{-4}$ |
| Eighth Layer (Second Green-Sensitive Emuslion Layer) | |
| Silver Iodobromide Emulsion (AgI: 4 mol %, high internal AgI type, corresponding sphere diameter: 0.55 μm, variation coefficient of corresponding sphere diameter: 20%, regular crystal grain/twinned crystal grain mixture, diameter/thickness ratio: 4) | |
| Coated amount as silver | 0.6 |
| Gelatin | 0.8 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| Ninth Layer (Third Green-Sensitive Emulsion Layer) | |
| Silver Iodobromide Emulsion (AgI: 10 mol %, high internal AgI type, corresponding sphere diameter: 0.7 μm, variation coefficient of corresponding sphere diameter: 30%, regular crystal grain/twinned crystal grain mixture, diameter/thickness ratio: 2.0) | |
| Coated amount as silver | 0.85 |
| Gelatin | 1.0 |
| ExS-4 | $2.0 \times 10^{-4}$ |

-continued

| | |
|---|---|
| ExS-5 | $2.0 \times 10^{-4}$ |
| ExS-6 | $0.2 \times 10^{-4}$ |
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-2 | 0.01 |
| Cpd-5 | $4 \times 10^{-4}$ |
| Tenth Layer (Yellow Filter Layer) | |
| Gelatin | 0.9 |
| Yellow Colloidal Silver | 0.05 |
| Cpd-1 | 0.2 |
| Solv-1 | 0.15 |
| Cpd-5 | $4 \times 10^{-4}$ |
| Eleventh Layer (First Blue-Sensitive Emulsion Layer) | |
| Silver Iodobromide Emulsion (AgI: 4 mol %, high internal AgI type, corresponding sphere diameter: 0.5 μm, variation coefficient of corresponding sphere diameter: 15%, octahedral grains) | |
| Coated amount as silver | 0.4 |
| Gelatin | 1.0 |
| ExS-8 | $2 \times 10^{-4}$ |
| ExY-16 | 0.9 |
| ExY-14 | 0.09 |
| Solv-1 | 0.3 |
| Cpd-2 | 0.01 |
| Cpd-5 | $4 \times 10^{-4}$ |
| Twelfth Layer (Second Blue-Sensitive Emulsion Layer) | |
| Silver Iodobromide Emulsion (AgI: 10 mol %, high internal AgI type, corresponding sphere diameter: 1.3 μm, variation coefficient of corresponding sphere diameter: 25%, regular crystal grain/twinned crystal grain mixture, diameter/thickness ratio: 4.5) | |
| Coated amount as silver | 0.5 |
| Gelatin | 0.6 |
| ExS-8 | $1 \times 10^{-4}$ |
| ExY-16 | 0.12 |
| Solv-1 | 0.04 |
| Cpd-2 | $1 \times 10^{-3}$ |
| Cpd-5 | $2 \times 10^{-4}$ |
| Thirteenth Layer (First Protective Layer) | |
| Fine Grained Silver Iodobromide (average grain size: 0.07 μm, AgI: 1 mol %) | 0.2 as Ag |
| Gelatin | 0.8 |
| UV-3 | 0.1 |
| UV-4 | 0.1 |
| UV-5 | 0.2 |
| Solv-3 | 0.04 |
| Cpd-5 | $3 \times 10^{-4}$ |
| Fourteenth Layer (Second Protective Layer) | |
| Gelatin | 0.9 |
| Poly(methyl methacrylate) Particles (diameter: 1.5 μm) | 0.2 |
| Cpd-5 | $4 \times 10^{-4}$ |
| H-1 | 0.4 |

Surfactant was added to each layer as a coating promotor in addition to the components indicated above. The sample prepared in this way was Sample 301.

The chemical structural formulae or chemical names of the compounds used in the example are indicated below.

UV-4:

UV-5:

-continued
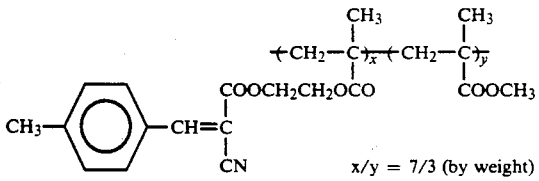
x/y = 7/3 (by weight)
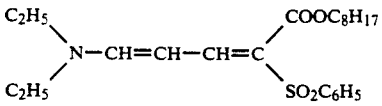
UV-1
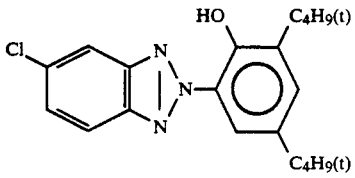
UV-2
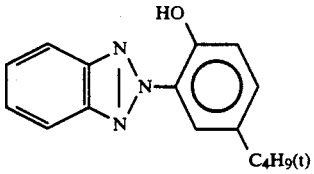
UV-3
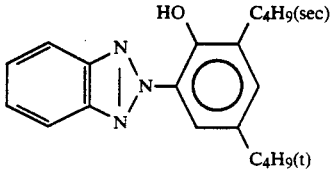
Solv-1: Tricresyl phosphate
Solv-2: Dibutyl phthalate
Solv-3: Bis(2-ethylhexyl)phthalate
ExM-8:
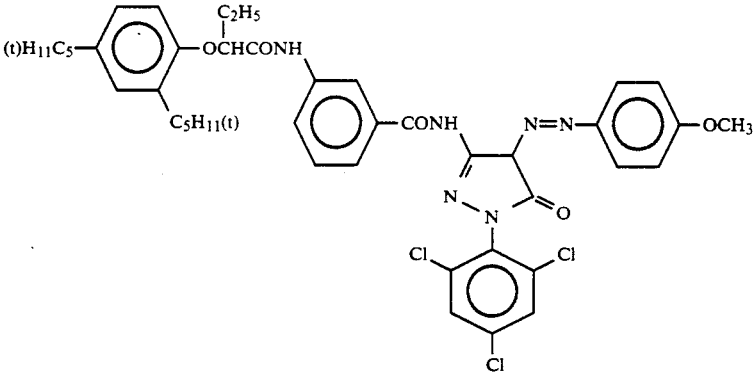
ExF-1:
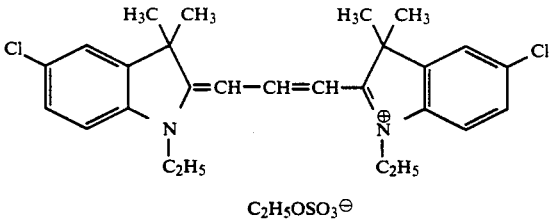
ExC-2:
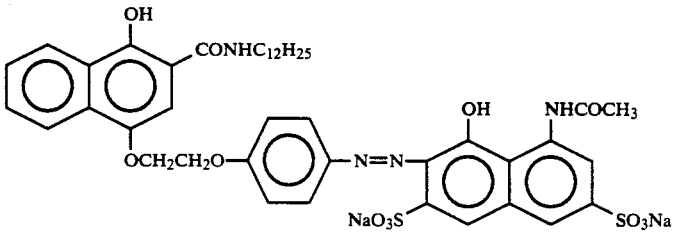
ExC-3:

-continued
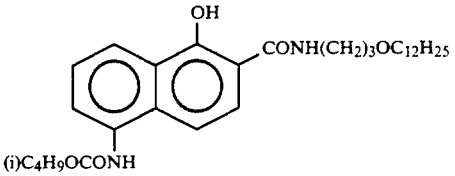
ExY-14:
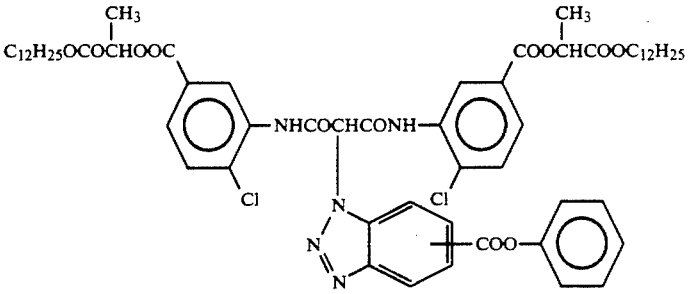
ExC-4:
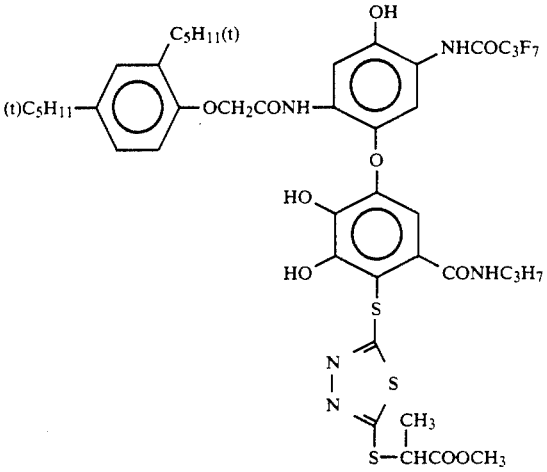
ExY-15:
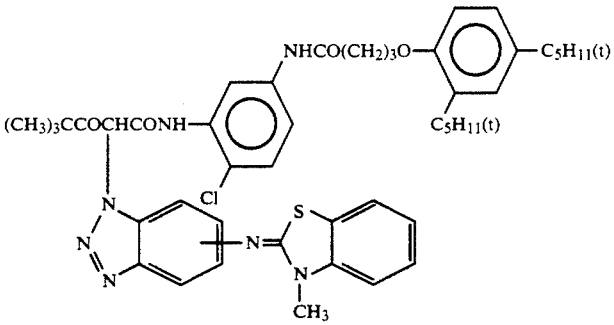
ExC-5:
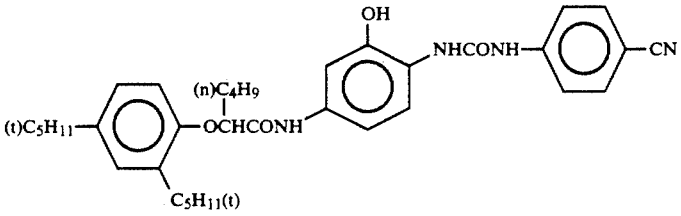
ExC-6:
ExC-7:

-continued
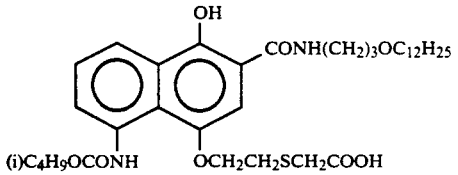
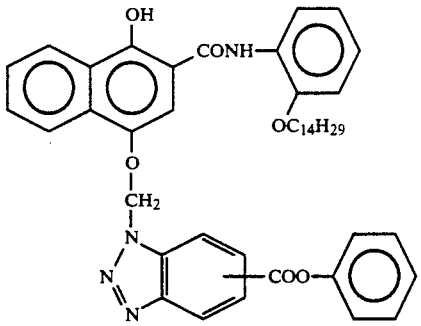
ExM-9:
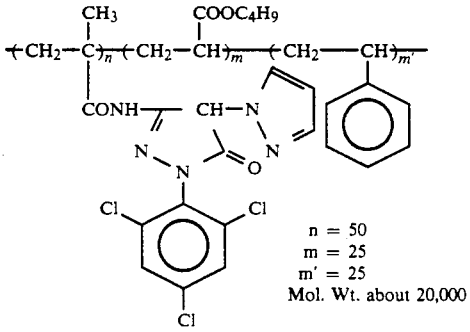
n = 50
m = 25
m' = 25
Mol. Wt. about 20,000
ExM-10:
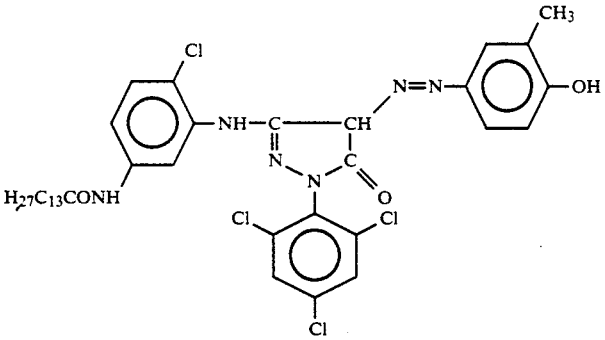
ExM-12:
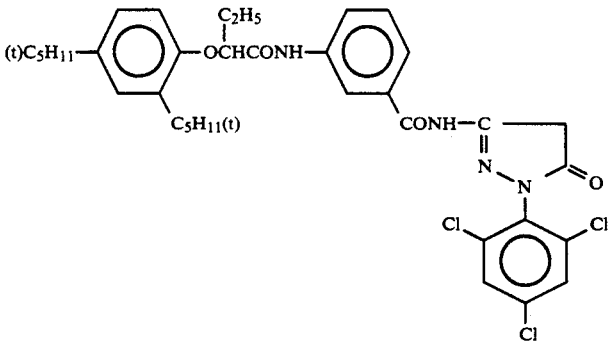
ExM-13:

-continued
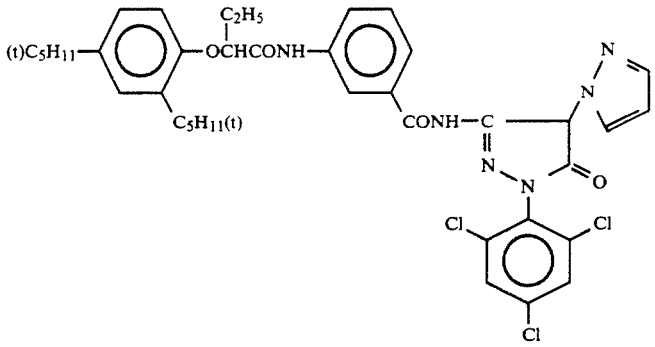
ExY-16:
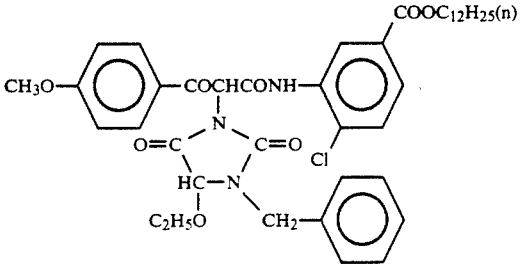
Cpd-1:
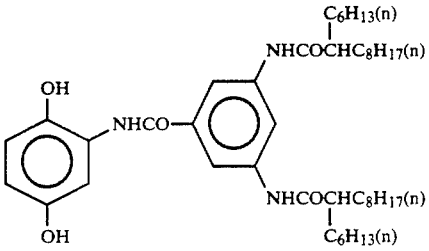
Cpd-2:
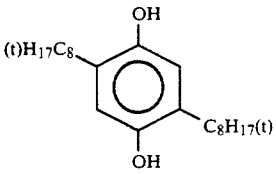
ExS-1:
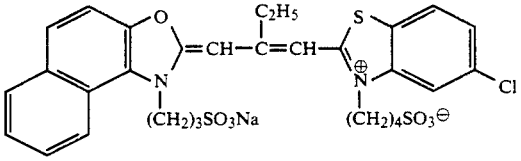
ExS-2:
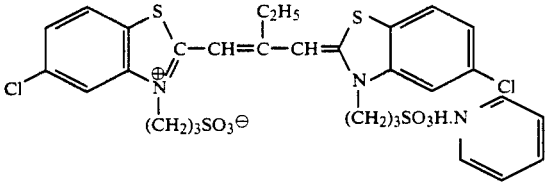
ExS-3:
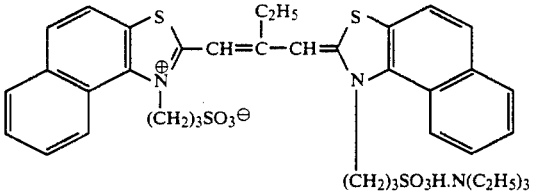
ExS-4:
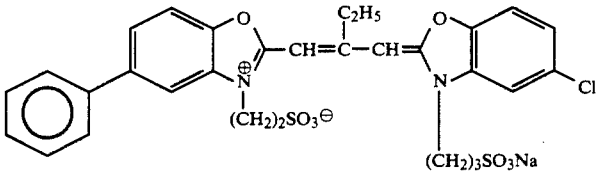
ExS-5:
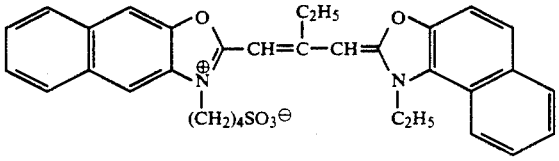
ExS-6:

-continued

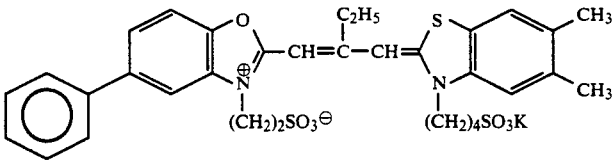

ExS-7:

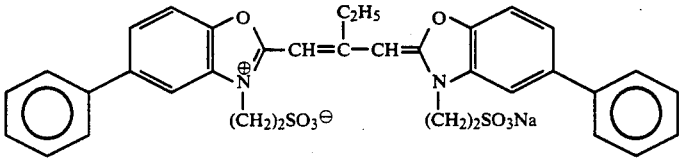

ExS-8:

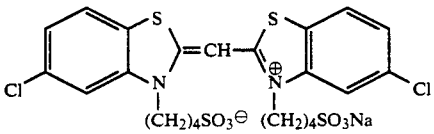

H-1:

$CH_2{=}CH{-}SO_2{-}CH_2{-}CONH{-}CH_2$
$CH_2{=}CH{-}SO_2{-}CH_2{-}CONH{-}CH_2$

Cpd-3:

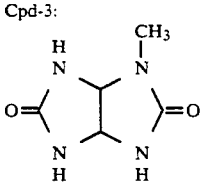

Cpd-4:

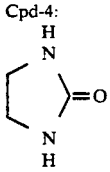

Cpd-5:

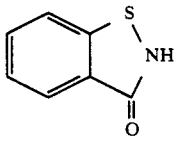

The dry film thickness of all the coated layers except the support and the subbing layer of the support in Sample 301 prepared in this way was 17.6 μm. Furthermore, T½ was 8 seconds.

The sample prepared was cut and finished to a width of 35 mm, exposed through a wedge with white light (color temperature of light source: 4,800° K.) in such a way that the exposure in the maximum density part was 20 CMS and processed in an automatic processor for motion picture film using the processing operations indicated below.

Processing Operations

| Process | Processing Time | Processing Temperature (°C.) |
|---|---|---|
| Color Development | 3 min 15 sec | 38 |
| Bleaching | 40 sec | 38 |
| Bleach-Fixing | 40 sec | 38 |
| Fixing | 40 sec | 38 |
| Water Washing (1) | 15 sec | 38 |
| Water Washing (2) | 15 sec | 38 |
| Stabilization | 20 sec | 38 |
| Drying | 1 min | 55 |

TABLE 3

| Processing No. | Bleach-Fixing Solution: Bleaching Agent | Bleaching Agent Concentration (mol/liter) | Aminopolycarboxylic Acid | Aminopolycarboxylic Acid Concentration (mol/liter) | $D_{min}$ | Remarks |
|---|---|---|---|---|---|---|
| 5-1 | C-7* | 0.02 | — | — | 0.14 | Comparison |
| 5-2 | C-7* | 0.04 | — | — | 0.23 | Comparison |
| 5-3 | C-7* | 0.08 | — | — | 0.45 | Comparison |
| 5-4 | C-7* | 0.02 | A-1 | 0.04 | 0.00 | Invention |
| 5-5 | C-7* | 0.04 | A-1 | 0.04 | 0.00 | Invention |
| 5-6 | C-7* | 0.04 | A-1 | 0.03 | 0.00 | Invention |
| 5-7 | C-7* | 0.04 | A-1 | 0.02 | 0.03 | Invention |
| 5-8 | C-7* | 0.04 | A-1 | 0.08 | 0.00 | Invention |
| 5-9 | C-7* | 0.08 | A-1 | 0.08 | 0.00 | Invention |
| 5-10 | C-7* | 0.04 | A-8 | 0.04 | 0.02 | Invention |
| 5-11 | C-7* | 0.04 | A-18 | 0.04 | 0.02 | Invention |
| 5-12 | C-1** | 0.04 | A-1 | 0.04 | 0.03 | Invention |

TABLE 3-continued

| Processing No. | Bleach-Fixing Solution: Bleaching Agent | Bleaching Agent Concentration (mol/liter) | Aminopolycarboxylic Acid | Aminopolycarboxylic Acid Concentration (mol/liter) | $D_{min}$ | Remarks |
|---|---|---|---|---|---|---|
| 5-13 | C-4*** | 0.04 | A-1 | 0.04 | 0.03 | Invention |

*Ammonium salt monohydrate of C-7
**Ammonium salt monohydrate of C-1
***Ammonium salt monohydrate of C-4

Moreover, the processing solution compositions were the same as the start liquor in Example 1 except that the amounts were changed as shown in Table 3 in the bleach-fixing solution prepared by mixing the bleaching agent in the bleaching solution and the aminopolycarboxylic acid in the fixing solution. The increase in density in the unexposed parts on storing samples which had been processed in each processing operation and processing solution was investigated under the storage conditions indicated below.

Dark temperature and humidity conditions: 60° C., 70% RH, 10 days.

$D_{min}$ in green light of the unexposed parts was measured before and after storage under the conditions indicated above and staining was evaluated by calculating $\Delta D_{min}$=($D_{min}$ after test completed)−($D_{min}$ before test). The results obtained are shown in Table 3.

It is clear from these results that there is less staining when processing is carried out in a bleach-fixing solution of the present invention irrespective of the amount of bleaching agent in the bleach-fixing solution. In particular, C-7 (1,3-PDTA.Fe) is good as the bleaching agent in the bleaching solution and A-1 (EDTA) is good as the aminopolycarboxylic acid in the fixing solution.

Furthermore, it is clear that the inclusion of not more than twice the amount of the aminopolycarboxylic acid of bleaching agent is preferred in the bleach-fixing solution. It is thought that this is because the aminopolycarboxylic acid ferric complex salt of which the redox potential is at least 150 mV undergoes chelate exchange as far as possible to the state of an aminopolycarboxylic acid ferric complex salt of which the redox potential is less than 150 mV.

EXAMPLE 4

Similar good effects to those observed in Example 2 were obtained when processing Nos. 1-1 to 1-9 described in Example 1 were carried out using the color negative films listed below.

Fuji Photo Film Co. Products:
- Fujicolor Super HRII 100 (Emulsion No. 603022)
- Fujicolor Super HG 200 (Emulsion No. 503011)
- Fujicolor Super HG 400 (Emulsion No. 303030)
- Fujicolor Super HRII 1600 (Emulsion No. 701002)
- Fujicolor REALA (Emulsion No. 802013)

Konika Co. Products:
- Konikacolor GXII 100 (Emulsion No. 712)
- Konikacolor GX 400 (Emulsion No. 861)
- Konikacolor GX 3200 (Emulsion No. 758)

Eastman Kodak Company Products:
- Kodacolor Gold 100 (Emulsion No. 819 D31A)
- Kodacolor Gold 200 (Emulsion No. 5096 631)
- Kodacolor Gold 400 (Emulsion No. 003 D18A)
- Kodak Ektar 1000 (Emulsion No. 107 D11A)

EXAMPLE 5

Processing was carried out in the same manner as processing No. 1-6 of Example 1 except that the bleach-fixing and fixing times in processing operation (2) in Example 1 were each changed to 30 seconds and the pH and the amount of imidazole added to the fixing solution in Example 1 were changed as shown in Table 4.

Color restoration properties and fixing properties were evaluated after processing as described above.

The color restoration properties were evaluated in the same manner as in Example 1. Furthermore, the fixing properties were evaluated by obtaining the residual silver content using the fluorescent X-ray method on processing unexposed Sample 101. The results obtained are shown in Table 4.

TABLE 4

| Processing No. | Fixing Solution pH | Imidazole Concentration in the Fixing Solution (mol/liter) | Color Restoration Properties (%) | Fixing Properties ($\mu g/cm^2$) |
|---|---|---|---|---|
| 5-1 | 6 | 0 | 82 | 14 |
| 5-2 | 6.5 | 0 | 94 | 8 |
| 5-3 | 7 | 0 | 95 | 7 |
| 5-4 | 8 | 0 | 95 | 7 |
| 5-5 | 9 | 0 | 94 | 8 |
| 5-6 | 6 | 0.1 | 87 | 12 |
| 5-7 | 6.5 | 0.1 | 96 | 7 |
| 5-8 | 7 | 0.1 | 97 | 6 |
| 5-9 | 8 | 0.1 | 97 | 6 |
| 5-10 | 9 | 0.1 | 96 | 7 |
| 5-11 | 6 | 0.2 | 89 | 11 |
| 5-12 | 6.5 | 0.2 | 99 | 3 |
| 5-13 | 7 | 0.2 | 100 | 2 |
| 5-14 | 8 | 0.2 | 100 | 2 |
| 5-15 | 9 | 0.2 | 98 | 3 |
| 5-16 | 6 | 0.4 | 90 | 10 |
| 5-17 | 6.5 | 0.4 | 100 | 2 |
| 5-18 | 7 | 0.4 | 100 | 1 |
| 5-19 | 8 | 0.4 | 100 | 1 |
| 5-20 | 9 | 0.4 | 99 | 3 |

Results for the present invention are enclosed in the frames.

It is clear from the results of Table 4 that setting the pH of the fixing solution within the range of the present invention has a beneficial effect on the color restoration properties and the fixing properties. Furthermore, even better results are obtained when the imidazole content of the fixing solution is 0.2 mol/liter or more.

EXAMPLE 6

Running processing was carried out in the same manner as processing No. 1-6 of Example 1 except that equimolar amounts of the compounds indicated below in place of the imidazole in the fixing solution in processing No. 1-6 of Example 1 were used and the fixing properties and color restoration properties were investigated in the same manner as in Example 5. The results obtained are shown in Table 5.

Similar results to those obtained using imidazole were obtained in respect of both fixing properties and color restoration properties.

TABLE 5

| Process No. | Fixing Compound | Fixing Properties (%) | Color Restoration Properties ($\mu g/cm^2$) |
|---|---|---|---|
| 1-6 (Example 1) | Imidazole | 100 | 1 |
| 6-1 | 1-Methylimidazole | 99 | 2 |
| 6-2 | 2-Methylimidazole | 99 | 2 |
| 6-3 | 4-Hydroxyimidazole | 98 | 3 |

While the invention has been described in detail and with reference to specific embodiments thereof, it will be apparent to one skilled in the art that various changes and modifications can be made therein without departing from the spirit and scope thereof.

What is claimed is:

1. A method for processing silver halide color photographic materials comprising:

(1) color-developing an imagewise exposed silver halide color photographic material containing a color coupler with a primary aromatic amine-based color developing agent, and then (2) desilvering said photographic material by a process comprising the following steps conducted in sequence:

(a) treating in a bleaching bath, (b) treating in a bleach-fixing bath, and (c) treating in a fixing bath, wherein said bleaching bath is a bath of a bleaching solution having a pH of not more than 5.0 which contains an aminopolycarboxylic acid ferric complex salt having a redox potential of at least 150 mV, said fixing bath is a bath of a fixing solution having a pH of at least 6.5 which contains an aminopolycarboxylic acid whose corresponding ferric complex salt has a redox potential of less than 150 mV, or a salt of said acid, and said bleach-fixing bath comprises at least a bleaching solution which has been introduced from said bleaching bath and a fixing solution which has been introduced from said fixing bath.

2. The method for processing silver halide color photographic materials as claimed in claim 1, wherein at least one said fixing bath and said bleach-fixing bath further comprise a compound represented by formula (I):

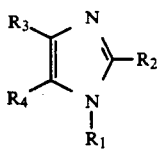

(I)

wherein $R_1$, $R_2$, $R_3$ and $R_4$ represent a hydrogen atom, an alkyl group or an alkenyl group.

3. The method for processing silver halide color photographic materials as claimed in claim 1, wherein said redox potential of the aminopolycarboxylic acid ferric complex salt contained in said bleaching solution is at least 180 mV.

4. The method for processing silver halide color photographic materials as claimed in claim 1, wherein said bleaching solution contains the aminopolycarboxylic acid ferric complex salt having the redox potential of at least 150 mV in an amount of at least 0.10 mol per liter of the bleaching solution.

5. The method for processing silver halide color photographic materials as claimed in claim 1, wherein said bleaching solution has a pH of from 2.0 to 5.0.

6. The method for processing silver halide color photographic materials as claimed in claim 1, wherein said bleaching solution further contains an inorganic or organic acid having a pKa value of from 2.0 to 5.5, provided that the aminopolycarboxylic acid and its salts and its iron complex salts are excluded.

7. The method for processing silver halide color photographic materials as claimed in claim 6, wherein said inorganic or organic acid is contained in an amount of from 0.8 to 2.5 mol per liter of the bleaching solution.

8. The method for processing silver halide color photographic materials as claimed in claim 1, wherein the ferric complex salt and the salt corresponding to said aminopolycarboxylic acid contained in said fixing solution has a redox potential of not more than 110 mV.

9. The method for processing silver halide color photographic materials as claimed in claim 1, wherein said fixing solution contains the aminopolycarboxylic acid or the salt of said acid whose corresponding ferric complex salt has the redox potential of less than 150 mV in an amount of at least 0.01 mol per liter of the fixing solution.

10. The method for processing silver halide color photographic materials as claimed in claim 1, wherein said fixing solution has a pH of from 6.5 to 9.0.

11. The method for processing silver halide color photographic materials as claimed in claim 1, wherein said fixing solution further contains a compound having a pKa value of from 6.0 to 9.0.

12. The method for processing silver halide color photographic materials as claimed in claim 1, wherein said aminopolycarboxylic acid ferric complex salt contained in the bleaching solution is 1,3-propylenediaminetetraacetic acid ferric complex salt.

13. The method for processing silver halide color photographic materials as claimed in claim 8, wherein said aminopolycarboxylic acid contained in the fixing solution is ethylenediaminetetraacetic acid.

14. The method for processing silver halide color photographic materials as claimed in claim 2, wherein said compound represented by formula (I) is contained in an amount of from 0.2 mol to the solution limit per liter of the fixing solution and/or the bleach-fixing solution.

15. The method for processing silver halide color photographic materials as claimed in claim 14, wherein said compound represented by formula (I) is contained in an amount of from 0.2 to 2 mol per liter of the fixing solution and/or the bleach-fixing solution.

16. The method for processing silver halide color photographic materials as claimed in claim 11, wherein said compound having a pKa value of from 6.0 to 9.0 is contained in an amount of from 0.1 to 10 mol per liter of the fixing solution.

17. The method for processing silver halide color photographic materials as claimed in claim 16, wherein said compound having a pKa value of from 6.0 to 9.0 is contained in an amount of from 0.2 to 3 mol per liter of the fixing solution.

18. The method for processing silver halide color photographic materials as claimed in claim 1, wherein said fixing solution, said bleach-fixing solution or both said fixing solution and said bleach-fixing solution further contain a compound represented by formula (II) or (III):

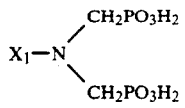

(II)

wherein $X_1$ represents a hydrogen atom, an alkyl group or an aryl group;

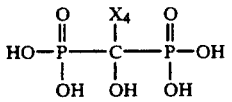

(III)

wherein $X_4$ represents an alkyl group which has from 1 to 4 carbon atoms.

19. The method for processing silver halide color photographic materials as claimed in claim 1, wherein said silver halide color photographic material comprises photographic emulsion layers containing at least one of silver iodobromides, silver iodochlorides and silver iodochlorobromides, having a silver iodide content of from 0.1 to 30 mol%.

20. The method for processing silver halide color photographic materials as claimed in claim 18, wherein represents $-L-PO_3H_2$ or

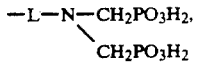

and L represents an alkylene group having from 1 to 6 carbon atoms or a phenylene group.

21. The method for processing silver halide color photographic materials as claimed in claim 20, wherein L represents and alkylene group having from 1 to 6 carbon atoms.

* * * * *